US012656032B2

(12) United States Patent
Lang et al.

(10) Patent No.: US 12,656,032 B2
(45) Date of Patent: Jun. 16, 2026

(54) CONFIGURABLE MANIFOLD SYSTEM

(71) Applicant: Thermo Fisher Scientific (Asheville) LLC, Asheville, NC (US)

(72) Inventors: Nathan Norman Lang, Rochester, NH (US); Derek St. Gelais, Berwick, ME (US); Warren C Prouty, Danville, NH (US)

(73) Assignee: Thermo Fisher Scientific (Asheville) LLC, Asheville, NC (US)

( * ) Notice: Subject to any disclaimer, the term of this patent is extended or adjusted under 35 U.S.C. 154(b) by 393 days.

(21) Appl. No.: 18/173,966

(22) Filed: Feb. 24, 2023

(65) Prior Publication Data

US 2023/0314053 A1 Oct. 5, 2023

Related U.S. Application Data

(60) Provisional application No. 63/327,100, filed on Apr. 4, 2022.

(51) Int. Cl.
*F25B 41/40* (2021.01)
*F25B 41/20* (2021.01)

(52) U.S. Cl.
CPC ..... *F25B 41/40* (2021.01); *F25B 41/20* (2021.01); *F25B 2400/21* (2013.01)

(58) Field of Classification Search
CPC ..... F25B 41/40; F25B 2400/21; F25B 41/20; F16L 41/00
See application file for complete search history.

(56) References Cited

U.S. PATENT DOCUMENTS

| | | | |
|---|---|---|---|
| 4,726,399 | A | 2/1988 | Miller |
| 6,302,149 | B1 | 10/2001 | Sato |
| 6,502,601 | B2 | 1/2003 | Eidsmore et al. |
| 6,629,546 | B2 | 10/2003 | Eidsmore |
| 6,644,353 | B1 | 11/2003 | Eidsmore |
| 6,776,193 | B2 | 8/2004 | Eidsmore |
| 6,929,032 | B2 | 8/2005 | Rehder et al. |
| 6,938,644 | B2 | 9/2005 | Eidsmore |
| 7,021,671 | B2 | 4/2006 | Evans et al. |

(Continued)

FOREIGN PATENT DOCUMENTS

| | | |
|---|---|---|
| EP | 2 492 573 A1 | 8/2012 |
| EP | 2 821 712 A1 | 1/2015 |

OTHER PUBLICATIONS

LSP Industries, ExpandaFold, 2001 https://lspind.com/expandafold.html.

*Primary Examiner* — Elizabeth J Martin

(57) ABSTRACT

A manifold system including a plurality of manifold blocks form a fluid conduit for fluid flow through the manifold system. The manifold blocks are removably coupled together. The manifold block includes a tubular body defining a first fluid passageway having a first flow axis. The first end includes a first female union defined by a first mounting flange and a neck extending from the first mounting flange in along the first flow axis toward the second end of the tubular body defining an opening to the first fluid passageway of the tubular body at the first end. The second end includes a male union defined by an annular flange and a tubular connector extending from the annular flange along the first flow axis to the second end of the tubular body defining an opening to the first fluid passageway at the second end.

9 Claims, 20 Drawing Sheets

(56) References Cited

U.S. PATENT DOCUMENTS

| | | | |
|---|---|---|---|
| 7,036,528 | B2 | 5/2006 | Eidsmore |
| 7,048,007 | B2 | 5/2006 | Nordstrom et al. |
| 7,111,644 | B2 | 9/2006 | Rehder et al. |
| 7,195,037 | B2 | 3/2007 | Eidsmore |
| 7,404,417 | B2 | 7/2008 | Eidsmore |
| 7,458,397 | B2 | 12/2008 | Doyle |
| 7,686,041 | B2 | 3/2010 | Eidsmore et al. |
| 7,712,486 | B2 | 5/2010 | Eldsmore |
| 7,862,321 | B2 | 1/2011 | Rozema et al. |
| 8,327,879 | B2 | 12/2012 | Ellis |
| 8,333,214 | B2 | 12/2012 | Ellis |
| 8,336,573 | B2 | 12/2012 | Ellis |
| 8,465,268 | B2 | 6/2013 | Baxter et al. |
| 9,426,927 | B2 | 8/2016 | Shafer et al. |
| 9,745,885 | B2 | 8/2017 | Geminn et al. |
| 9,791,082 | B2 | 10/2017 | Baxter et al. |
| 9,816,494 | B2 | 11/2017 | Dille |
| 9,913,402 | B2 | 3/2018 | Shafer et al. |
| 9,982,795 | B2 | 5/2018 | Twelftree |
| 10,107,407 | B2 | 10/2018 | Morgan et al. |
| 10,627,034 | B2 | 4/2020 | Sasaki et al. |
| 10,871,059 | B2 | 12/2020 | Keihany et al. |
| 10,995,894 | B2 | 5/2021 | Kawasaki et al. |
| 11,060,627 | B2 | 7/2021 | Villeret et al. |
| 11,085,266 | B2 | 8/2021 | Thomeer et al. |
| 11,098,964 | B1 | 8/2021 | Martin et al. |
| 2001/0027817 | A1* | 10/2001 | Giacomini ..... F16L 41/03 137/884 |
| 2002/0000256 | A1 | 1/2002 | Eidsmore et al. |
| 2004/0065364 | A1* | 4/2004 | Evans ..... E03F 1/002 210/150 |
| 2004/0194834 | A1* | 10/2004 | Rehder ..... F16K 27/003 137/884 |
| 2006/0283514 | A1 | 12/2006 | Rehder et al. |
| 2008/0111376 | A1 | 5/2008 | Ferrero |
| 2012/0312404 | A1* | 12/2012 | Choi ..... F16L 37/0927 137/883 |
| 2013/0319556 | A1 | 12/2013 | Prescott |
| 2020/0149650 | A1 | 5/2020 | Kidder et al. |
| 2020/0248724 | A1 | 8/2020 | Mollan et al. |
| 2020/0325743 | A1 | 10/2020 | Brezden et al. |
| 2021/0079775 | A1 | 3/2021 | Keihany et al. |

* cited by examiner

CONFIGURABLE MANIFOLD SYSTEM

CROSS-REFERENCE TO RELATED APPLICATIONS

This application claims the benefit of U.S. Provision Application Ser. No. 63/327,100 filed Apr. 4, 2022, the contents of which is hereby incorporated by reference as if set forth in its entirety herein.

TECHNICAL FIELD

The present invention relates generally to refrigerated process chillers and, more particularly, to a process fluid flow path of a refrigerated process chiller.

BACKGROUND

A typical refrigerated process chiller operates as a thermal device that removes heat generated by an application to which the chiller is connected. More particularly, the chiller circulates a process fluid through a closed or open process fluid flow loop that places the circulated process fluid in heat transferring communication with the application to which the chiller is connected. As the process fluid is circulated by the chiller to the application, the process fluid absorbs heat from the application to maintain, lower, or in some instances raise a temperature of the application. The heated process fluid is circulated through the chiller in this regard and undergoes a continuous cycle of refrigeration/absorption while removing heat from the associated application.

Refrigerated process chillers of the type described above are often used in laboratory or commercial applications that require close monitoring of the process fluid to provide functionality or monitoring for the application. As such, one or more sensing devices, such as a flowmeter, temperature sensor, or pressure sensor, for example, are installed within the process fluid flow path. In that regard, a section of the process fluid flow loop within the refrigerated process chiller, often referred to as a component stack up, will include components and several sensing devices located closely together for measuring characteristics of the process fluid, for example. As the process fluid flow loop is typically formed of copper tubing, the component stack up section of the process fluid flow loop includes commercially available copper fittings for integrating commercially available connectors for each sensing device or component to appropriately locate the sensing device or component within the process fluid flow path. To form the component stack up, the copper tubing and copper fittings are welded, soldered, or otherwise coupled with threaded or compression fittings.

The component stack up section of a conventional refrigerated process chiller fluid flow loop is costly to assemble and occupies a significant amount of space within the refrigerated process chiller. For example, assembly of a conventional component stack up requires personnel specially trained in soldering and brazing, and often requires the prefabrication of multiple sub-assemblies. Further, a conventional component stack up requires more space within the housing of the refrigerated process chiller as a result of the size of the copper fittings and connecters as well as the space needed to weld, or for the tools (e.g., wrenches) used to otherwise connect, the copper fittings for each sensing device or component in the component stack up. To this end, the generally permanent connections between the tubing and fittings for each sensing device in the component stack also up makes maintenance, repairs, and field upgrades extremely difficult. Each of these issues result in increased manufacturing and in-use costs for refrigerated process chillers.

In view of the above, there is a need for further improvements in refrigerated process chillers which address these and other deficiencies of known designs. More particularly, there is a need to reduce the manufacturing costs associated with assembling a component stack up section of a refrigerated process chiller process fluid flow loop. There is also a need to reduce the costs associated with maintenance, repairs, and field upgrades of sensing devices and/or components of such a component stack up section.

Therefore, there is a need for a modular manifold system that accommodates the one or more sensing devices and/or components in a component stack up section of a refrigerated process chiller process fluid flow loop that can be assembled quickly and efficiently without extensive or specialized tools, and which provides for easy field upgrades (i.e., the addition or removal of sensing devices or other components once the refrigerated process chiller is in-use).

SUMMARY OF THE INVENTION

According to one embodiment of the present invention, a manifold system includes a plurality of manifold blocks that form a fluid conduit for fluid flow through the manifold system. The manifold blocks can be removably coupled together. Each manifold block includes a tubular body that extends between a first end and an opposite second end to define a first fluid passageway through the manifold block that has a first flow axis. The first end of the manifold block includes a first female union defined by a first mounting flange and a neck that extends from the first mounting flange in a direction along the first flow axis toward the second end of the tubular body. The first female union defines an opening to the first fluid passageway of the tubular body at the first end. The second end of the manifold block includes a male union that is defined by an annular flange and a tubular connector that extends from the annular flange in a direction along the first flow axis to the second end of the tubular body The male union defines an opening to the first fluid passageway of the tubular body at the second end of the manifold block. The manifold block includes a second female union defined by a second mounting flange and a neck that extends from the second mounting flange in a direction toward the first fluid passageway to define a second fluid passageway in fluid communication with the first fluid passageway. The second female union includes a second flow axis oriented transverse to the first flow axis and defines an opening to the second fluid passageway of the tubular body that is in fluid communication with the first fluid passageway.

According to an aspect of the present invention, the first and the second female unions of the manifold block are each configured to selectively receive a male union of a second manifold block to removably couple the manifold block and the second manifold block together such that the first or second fluid passageway of the first manifold block and the first or second fluid passageway of the second manifold block form part of the fluid conduit of the manifold system.

According to another aspect of the present invention, the neck of the first female union and the neck of the second female union each comprise a pair of slots and the tubular connector of the male union comprises an annular groove configured to align with the pair of slots of a first or a second female union of the second manifold block when received therein. The manifold block is removably coupled to the second manifold block with a spring clip that is positioned within the pair of slots of the first or the second female union of the second manifold block and the annular groove of the male union of the manifold when aligned. According to a further aspect, the spring clip includes a first bowed portion and a second bowed portion configured to be received within the pair of slots and the annular groove.

According to one aspect of the present invention, the neck of the first female union and the neck of the second female union each include an enlarged portion that defines an annular wall and an annular shoulder that is configured to receive an annular flange of a male union of a second manifold block. According to a further aspect, each annular wall includes a plurality of indexing features spaced apart about a circumference of the annular wall. The indexing features are configured to orient a component or the second manifold block attached to the first or the second female union. In yet another aspect, the plurality of indexing features comprise notches in each annular wall. According to one aspect, the plurality of indexing features are each spaced apart in 45 degree increments about the circumference of the annular wall. According to another aspect, at least the annular shoulder of the second female union includes at least one indexing feature configured to engage an indexing feature of a component attached to the second female union to orient the component to be in an indexed position.

According to another embodiment of the invention, a chiller having a cabinet housing a refrigeration system and a process fluid flow loop for circulating a process fluid through a heat exchanger of the refrigeration system for adjusting a temperature of the process fluid is provided. The chiller includes a manifold system having a fluid conduit which forms part of the process fluid flow loop. The manifold system includes a support plate configured to support components of the manifold system within the cabinet of the chiller and at least a first and a second manifold block supported by the support plate. Each manifold block includes a tubular body that extends between a first end and an opposite second end to define a first fluid passageway through the manifold block that has a first flow axis. The first end of the manifold block includes a first female union defined by a first mounting flange and a neck that extends from the first mounting flange in a direction along the first flow axis toward the second end of the tubular body. The first female union defines an opening to the first fluid passageway of the tubular body at the first end. The second end of the manifold block includes a male union that is defined by an annular flange and a tubular connector that extends from the annular flange in a direction along the first flow axis to the second end of the tubular body The male union defines an opening to the first fluid passageway of the tubular body at the second end of the manifold block. The manifold block includes a second female union defined by a second mounting flange and a neck that extends from the second mounting flange in a direction toward the first fluid passageway to define a second fluid passageway in fluid communication with the first fluid passageway. The second female union includes a second flow axis oriented transverse to the first flow axis and defines an opening to the second fluid passageway of the tubular body that is in fluid communication with the first fluid passageway. To this end, the first and the second manifold blocks are attached to the support plate such that the first or second fluid passageway of the first manifold block and the first or second fluid passageway of the second manifold block form part of the fluid conduit of the manifold system.

According to one aspect of the present invention, the first and the second female unions of the first manifold block are each configured to selectively receive the male union of the second manifold block and the first and the second female unions of the second manifold block are each configured to selectively receive the male union of the first manifold block to permit removable coupling of the first and the second manifold blocks together.

According to another aspect of the present invention, at least one of the first or the second manifold blocks is coupled to the support plate with the first or the second mounting flange. In yet another aspect, the support plate further includes one or more removable plates to which the first or the second mounting flange is attached to support the first manifold block or the second manifold block from the support plate. According to one aspect, the support plate includes one or more removable brackets to which a component is attached to support component from the support plate such that the component forms part of the fluid conduit. In another aspect, the component is a flow control valve.

According to one aspect of the present invention, the manifold system comprises at least the first manifold block, the second manifold block, and a component supported from the support plate and coupled together in series to form the fluid conduit of the manifold system.

According to another aspect of the present invention, a device is removably coupled to an unused one of the male union or the first and the second female unions of the first and second manifold block so as to be in fluid communication with the process fluid flowing through the fluid conduit. In one aspect, the device includes any one of the following: a flowmeter; a pressure relief valve; a thermocouple; an oxygen sensor; a conductivity sensor; or a component fitting configured to receive a resistance temperature detector and a pressure transducer.

According to one aspect of the invention, a pressure relief valve for use with the manifold system is provided. The pressure relief valve is configured to be removably coupled to one of the first or the second female unions of the first or the second manifold block. The pressure relief valve includes a valve body having a chamber with an inlet port and an outlet port, and a poppet having a valve seat located within the chamber. The poppet is slideably guided by an upper seal such that the valve seat is movable between a closed and an open position for respectively closing and opening the inlet port. A spring is positioned between the poppet and a valve stem for normally biasing the valve seat to the closed position. The valve stem includes a handle for adjusting a force exerted on the poppet by the spring. The pressure relief valve also includes a male union that extends from a base of the valve body. The male union forms part of the inlet port and is configured to form a fluid connection with the first and the second female union structures to allow the pressure relief valve to be removably coupled thereto.

According to another aspect of the present invention, pressure relief valve further includes an annular groove formed in the male union and each of the first and the second manifold block further comprise a pair of slots formed in the neck of the first female union and the neck of the second female union. The pressure relief valve is removably coupled to one of the first or the second manifold blocks with a spring clip that is positioned within the pair of slots and the groove of the male union of the pressure relief valve.

According to yet another aspect of the present invention, the manifold system further includes a check valve positioned within the fluid conduit so as to be directly in a flow path of the process fluid flowing therethrough. In one aspect, the check valve is coupled between the male union of the first or the second manifold block and the first or the second female union of the other one of the first or second manifold block of the manifold system.

These and other objects and advantages of the invention will become more apparent during the following detailed description taken in conjunction with the drawings herein.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, explain the principles of the invention.

DETAILED DESCRIPTION

Embodiments of the present invention are directed to a modular manifold system that accommodates one or more sensing devices and components of a component stack up section of a refrigerated process chiller fluid flow loop. More particularly, the manifold system includes one or more modular manifold blocks removably coupled together, in a tool-less manner, to form a fluid conduit of the manifold system through which fluid coolant is circulated by the refrigerated process chiller. Each manifold block is configured to removably support at least one component or sensing device such that part of the component or sensing device is placed in fluid contact with the fluid coolant flowing through the fluid conduit of the modular manifold system. The connection between each component and the corresponding manifold block is also a tool-less connection that provides for proper orientation and/or indexing of the component or sensing device relative to the manifold block and the manifold system. In that regard, embodiments of the present invention can generally be assembled or disassembled by hand and thus eliminate the need for specialized tools and highly skilled labor for assembly or disassembly.

The modular and the tool-less assembly and disassembly capabilities of the manifold system widens the range of component compatibility and customer interface options available for use with the modular manifold system, and also makes easier any field upgrades by an end user (i.e., the addition of components and sensing devices to the refrigerated process chiller after its initial assembly). The modular manifold system of the present invention has a compact configuration and thus occupies a much smaller footprint within the refrigerated process chiller compared to a conventional component stack up formed of copper tubing and copper fittings. Each of these benefits of the modular manifold system of the present invention will be described in further detail below.

Figure 1:
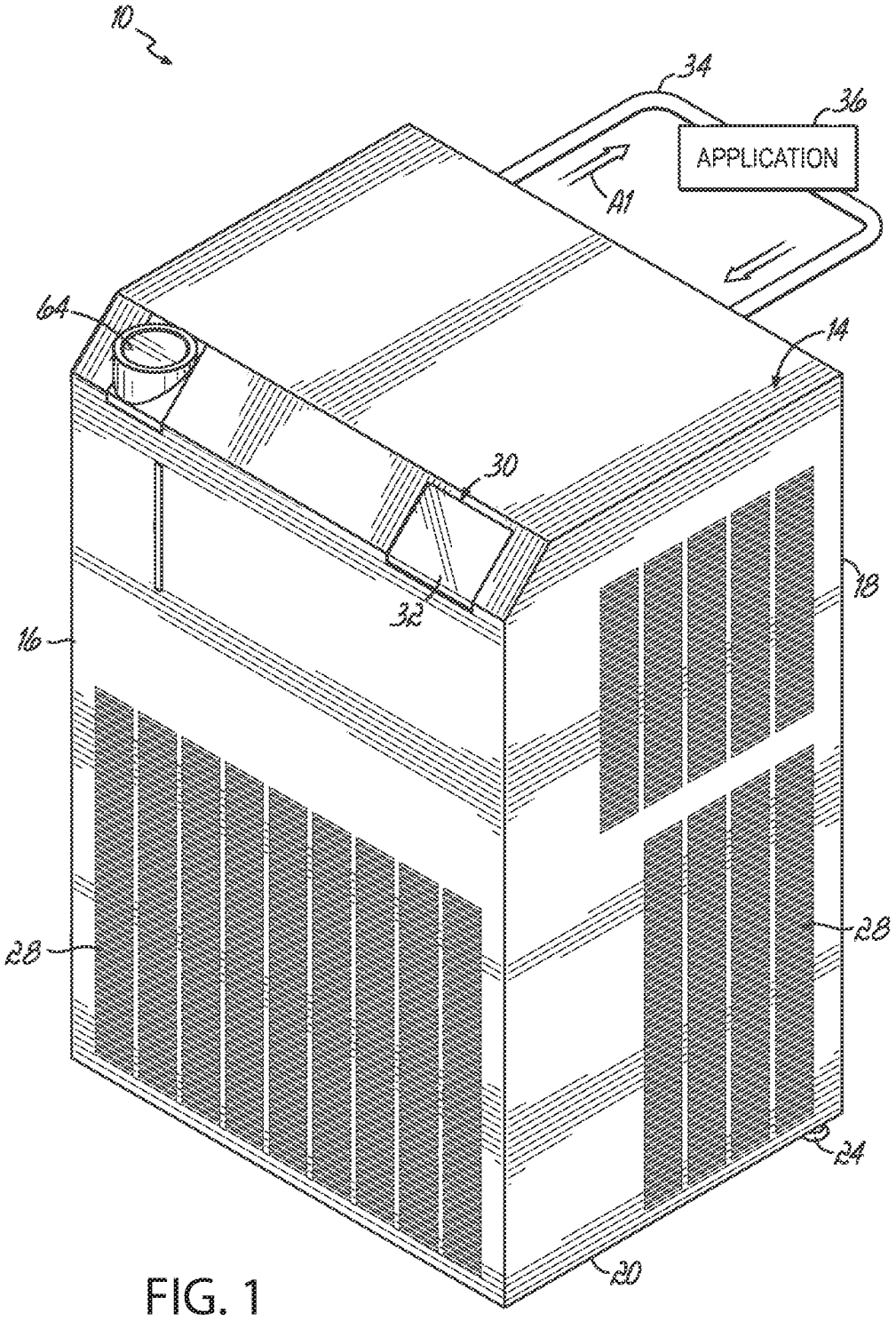
FIG. 1 is a perspective view of a refrigerated process chiller in accordance with an embodiment of the present invention.
Figure 2:
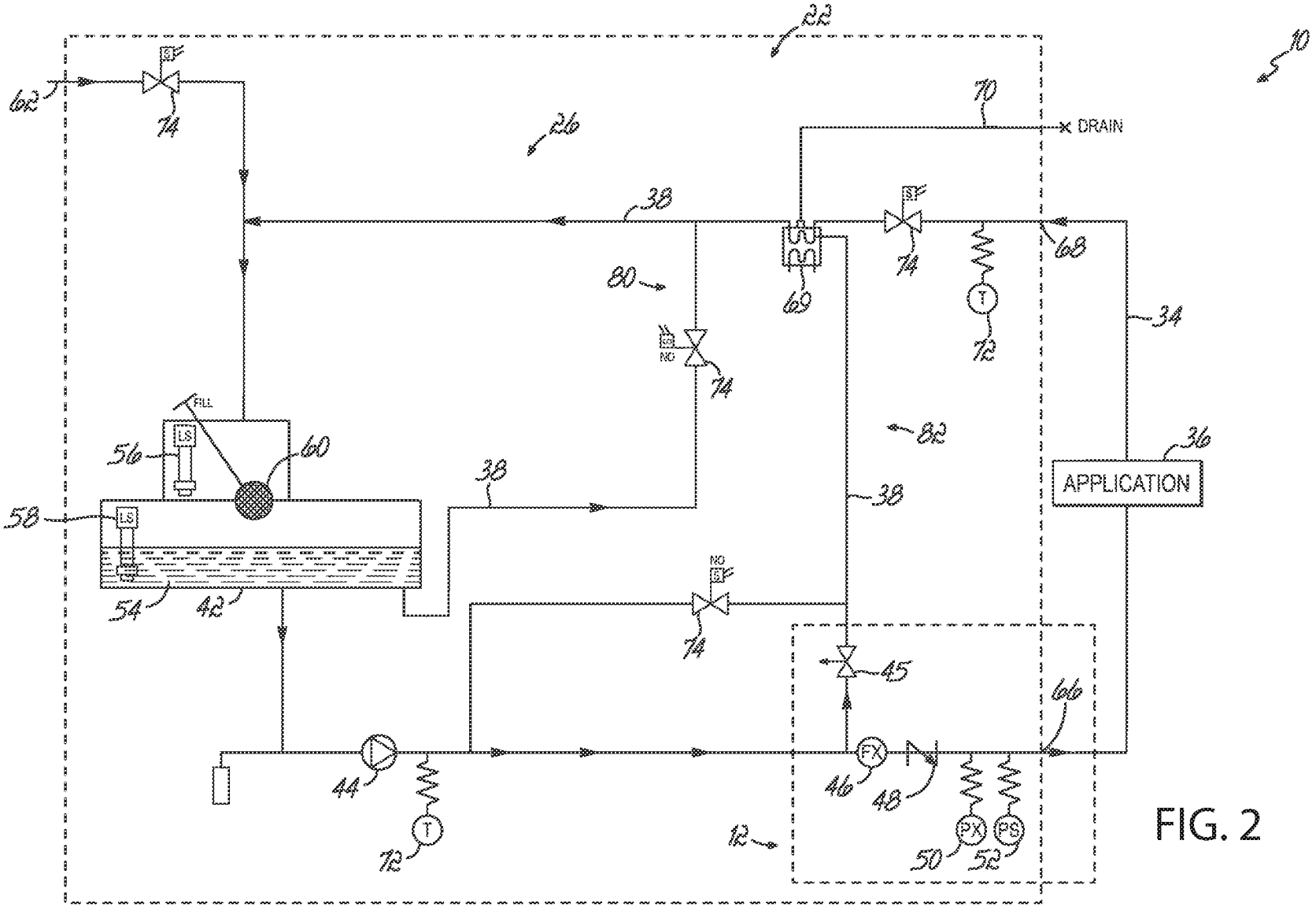
FIG. 2 is a schematic representation of an exemplary process fluid flow loop of the refrigerated process chiller of FIG. 1, schematically illustrating a manifold system in accordance with an embodiment of the present invention.

Referring now to FIG. 1, details of an exemplary refrigerated process chiller 10, otherwise referred to as a chiller, are shown in which a modular manifold system 12 (e.g., FIG. 4) according to embodiments of the present invention has particular utility. The refrigerated process chiller 10 includes a cabinet or housing 14, a front cover 16, a back cover 18, and a base 20 which together define an interior 22 of the chiller 10 (FIG. 2). The chiller 10 includes a number of feet 24, such as four, for example, configured to support the chiller 10 above the ground, tabletop, or other surface on which the chiller 10 is located. The housing 14 may include a lid (not shown) or the front cover 16 or the back cover 18 may be removable to provide access to a refrigeration system which includes a process fluid flow loop 26 (FIG. 2) as well as associated refrigeration components located in the interior 22 of the chiller 10, such as the modular manifold system 12. The housing 14, front cover 16, and/or back cover 18 may also include a plurality of openings 28 that allow air to reach the components located in the interior 22 of the housing 14. The refrigerated process chiller 10 may further include a human machine interface (HMI) 30 having a display 32 located on the front cover 16 of the housing 12, for example. In a preferred embodiment, the display 32 may comprise a liquid crystal display (LCD) or a touchscreen that enables a user to interact with the chiller 10 in a known manner, such as to enter data, view data, and/or change an operational parameter of the chiller 10 such as a temperature of the fluid coolant circulated by the chiller 10 or a flow rate of the fluid coolant through the chiller 10, for example.

The refrigerated process chiller 10 may have an open fluid flow loop or a closed fluid flow loop configuration and uses a continuous flow of fluid coolant, such as a liquid coolant, circulated through appropriate fluid lines to remove heat from an object or application in direct or indirect contact with the circulated fluid coolant, such as laboratory equipment, for example. As described in further detail below, the manifold system 12 forms part of the fluid flow loop 26 of the refrigerated process chiller 10. However, while the manifold system 12 is shown and described in the context of a refrigerated process chiller having certain characteristics, it will be understood that the same inventive concepts related to embodiments of the present invention may be implemented with different heating and/or cooling applications and systems without departing from the scope of the invention. More particularly, in its broader aspects, the inventive concepts related to the manifold system 12 may be implemented in any application having a fluid flow path, loop, or circuit that requires one or more components or sensing devices, which may be grouped together in series, but in no particular order, for measuring characteristics of a process fluid flowing therethrough. To this end, the drawings are not intended to be limiting.

With continued reference to FIG. 1, the refrigerated process chiller 10 includes one or more external fluid lines 34, such as piping or flexible tubing, that extend from the chiller 10 to an application 36 to which the chiller 10 is connected. The application 36 may be a heat generating device or source used in a laboratory setting, for example. In any event, the external fluid lines 34 form part of the fluid flow loop 26 of the chiller 10 and place the fluid coolant in heat transferring communication with the application 36 to which the chiller 10 is connected. In that regard, as fluid coolant is circulated through the fluid flow loop 26, it is circulated between the chiller 10 and the application 36 via the external fluid lines 34, as indicated by directional arrows A1. The chiller 10 adjusts a temperature of the fluid coolant 54 (FIG. 2) that is circulated through the fluid flow loop 26 to a temperature setpoint to maintain a desired temperature of the application 36. The fluid coolant 54 may be a liquid coolant such as water, or a mixture for example of water and ethylene glycol, or a mixture of polyethylene glycol and water, for example.

Referring now to FIG. 2, an exemplary process fluid flow loop 26 for the refrigerated process chiller 10 is shown diagrammatically in which components of the chiller 10 are fluidly coupled together via appropriate internal fluid lines 38 and the external fluid lines 34 to define the fluid flow loop 26. The internal fluid lines 38 may also be piping or flexible tubing, for example. As shown, the interior 22 of the chiller 10 includes a fluid reservoir or tank 42, a pump 44, and the manifold system 12 fluidly coupled together with internal fluid lines 38. The manifold system 12 is illustrated schematically as a section of the fluid flow loop 26 that includes one or more components and/or sensing devices such as a pressure relief valve 45, a flow transducer or flowmeter 46, a check valve 48, a pressure transducer 50, and a pressure switch 52. The manifold system 12 may further include an optional flow control valve located upstream of the flowmeter 46, as described in further detail below. However, these components are exemplary, and the manifold system 12 may include various other components known in the art such as a resistance temperature detector (RTD), a thermocouple, an oxygen sensor, and/or a conductivity sensor, as well as other components for measuring characteristics of the fluid coolant, as will be described in further detail below.

The fluid reservoir 42 is configured to contain an amount of the fluid coolant 54 to be circulated through the chiller 10. In this regard, the reservoir 42 may include an overflow switch 56, a level switch 58, and a filter 60, for example. However, the reservoir 42 may also include various other components known in the art, such as a heater, for example. The fluid coolant 54 is introduced into to the reservoir 42 and the fluid flow loop 26 through an inlet line 62 which may be accessible via a cap 64 (FIG. 1) located on the housing 14 of the chiller 10, for example. The pump 44 is fluidly coupled between the fluid reservoir 42 and the manifold system 12 to move fluid coolant 54 within the fluid flow loop 26. More particularly, the pump 44 is configured to direct fluid coolant 54 from the fluid reservoir 42, through the pump 44, through the manifold system 12 and to an outlet port 66 of the chiller 10 to which an external fluid line 34 or other user interface is connected. As will be described in further detail below, the manifold system 12 may include an interface fitting which forms the outlet port 66. In any event, the pump 44 continues to circulate the fluid coolant 54 through the one or more external fluid lines 34 to the application 36 and back to the chiller 10. The fluid coolant 54 enters the chiller 10 via an inlet port 68 to which the external fluid line 54 is connected. The fluid coolant 54 is then directed through a heat exchanger 69 which adjusts a temperature of the fluid coolant 54. The heat exchanger 69 is fluidly connected to a drain line 70 to drain fluid coolant 54 from the chiller 10 via the heat exchanger 69. The heat exchanger 69 may be a plate heat exchanger such as a gasketed, brazed, welded, or semi-welded plate heat exchanger, for example. From the heat exchanger 69, the fluid coolant 54 is pumped back to the fluid reservoir 42 for collection and recirculation. Circulation of the fluid coolant 54 in this regard is repeated to maintain a desired temperature of the application 36 or object to which the chiller 10 is operatively coupled.

With continued reference to FIG. 2, the fluid flow loop 26 may include one or more RTD temperature sensors 72 to monitor a temperature of the fluid coolant 54 flowing through the fluid flow loop 26, and one or more valves, such as solenoid valves 74, check valves 48, and relief valves to control flow of the fluid coolant 54 through the fluid flow loop 26. The fluid flow loop 26 includes a tank drain flow path 80 that utilizes a normally open (NO) solenoid valve 74 which opens when power is removed to direct fluid coolant 54 to the heat exchanger 69 and directly to the drain line 70. The fluid flow loop 26 also includes a bypass flow path 82 that directs the flow of fluid coolant 54 from the pump 44 directly to the heat exchanger 69 rather than to the application 36. The purpose of the bypass flow path 82 is to ensure a sufficient flow of fluid coolant 54 through the heat exchanger 69 to prevent damage to the heat exchanger 69 in the event flow to the application 36 is discontinued externally via a valve, blockage, etc.

Figure 3:
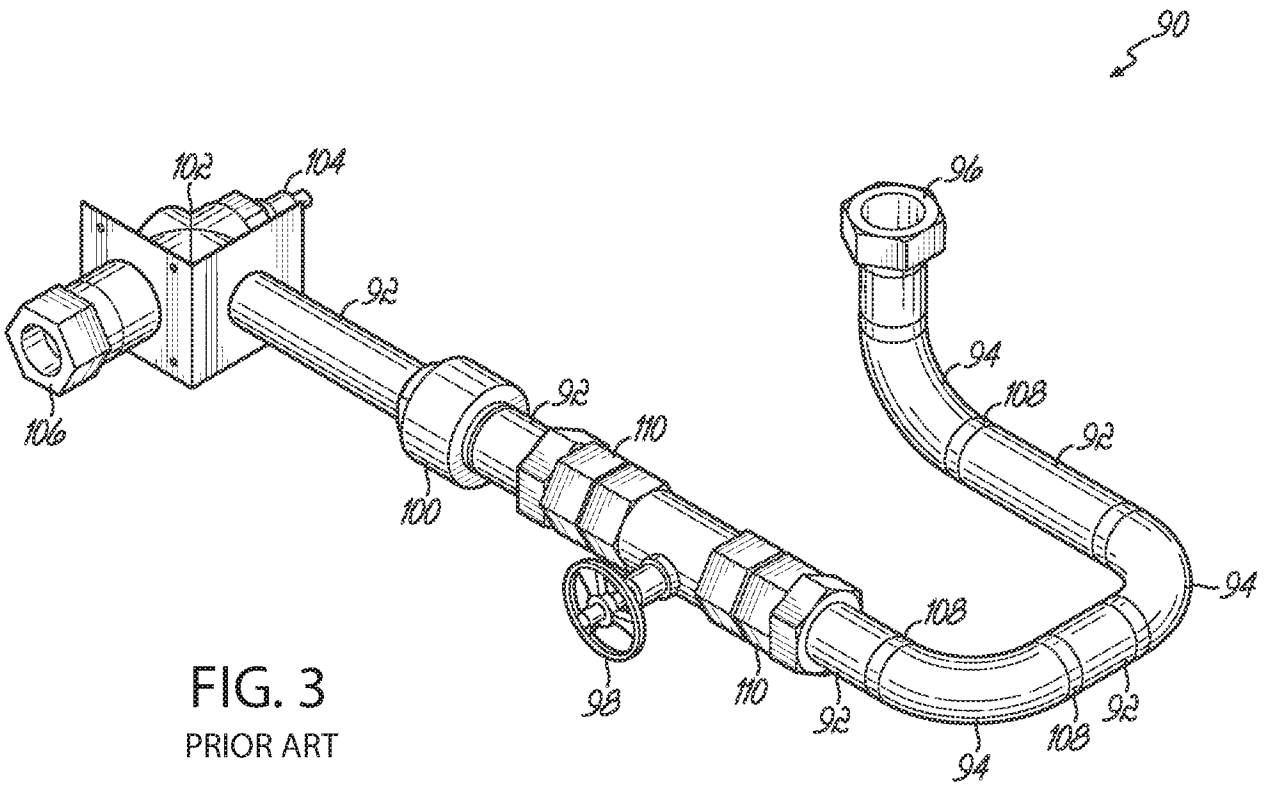
FIG. 3 PRIOR ART
FIG. 3 is an exemplary prior art component stack up section of a refrigerated process chiller fluid flow loop.

FIG. 3 illustrates an exemplary component stack up section 90 of a conventional process fluid flow loop of a refrigerated process chiller that existed prior to the manifold system 12 of the present invention, for example. As shown the component stack up section 90 includes straight sections 92 and elbow sections 94 of copper piping, an inlet connector 96, a flow control valve 98, a check valve 100, and a component fitting 102 configured to receive a pressure sensor 104 at one end and a customer interface fitting 106 at the other end. The customer interface fitting 106 may form the outlet port on the back of the chiller housing, for example. The sections 92, 94 of copper piping are welded or soldered together at joints 108 with at least the check valve 100 and the component fitting 102 also being welded or soldered between sections 92 of copper piping. The flow control valve 98 is coupled between sections 92 of copper piping with threaded compression fittings 110. Thus, assembly of the illustrated conventional component stack up section 90 requires soldering or welding as well as the necessary tools (e.g., wrenches) to attach the compression fittings 110 of the flow control valve 98 to the piping sections 92. To this end, sufficient space is required to accommodate the different types of connections between the components 98, 100, 102 and the piping sections 92, 94 that form the component stack up 90. Further, the permanent-type connections between the components 98, 100, 102 and the piping sections 92, 94 make it difficult to perform maintenance activities, replace, or add additional components once the chiller is in-use in the field, which is yet another drawback of the illustrated conventional component stack up section 90. As described in further detail below, the modular manifold system 12 of the present invention addresses the above-described drawbacks of the conventional component stack up section 90 of a process fluid flow loop of a refrigerated process chiller.

FIGS. 4-17 illustrate the modular manifold system 12 in accordance with one embodiment of the invention. In accordance with this embodiment, the manifold system 12 includes a support plate 120, which may be integrated into the back cover 18 of the chiller 10, configured to support a plurality of manifold blocks 122, an optional flow control valve 123, and an interface fitting 124, each of which is removably coupled together to form a fluid conduit 126 for fluid coolant 54 flow through the manifold system 12 between an inlet 128 defined by the flow control valve 123 and an outlet 130 defined by the interface fitting 124. The flow control valve 123 is illustrated as a 3-way flow control valve but may alternatively be a 2-way flow control valve, for example. In any event, as will be described in further detail below, the flow control valve 123, the plurality of manifold blocks 122, and the interface fitting 124 are fluidly coupled together in a removable and tool-less manner to form the fluid conduit 126 for fluid flow through the manifold system 12.

Figure 4:
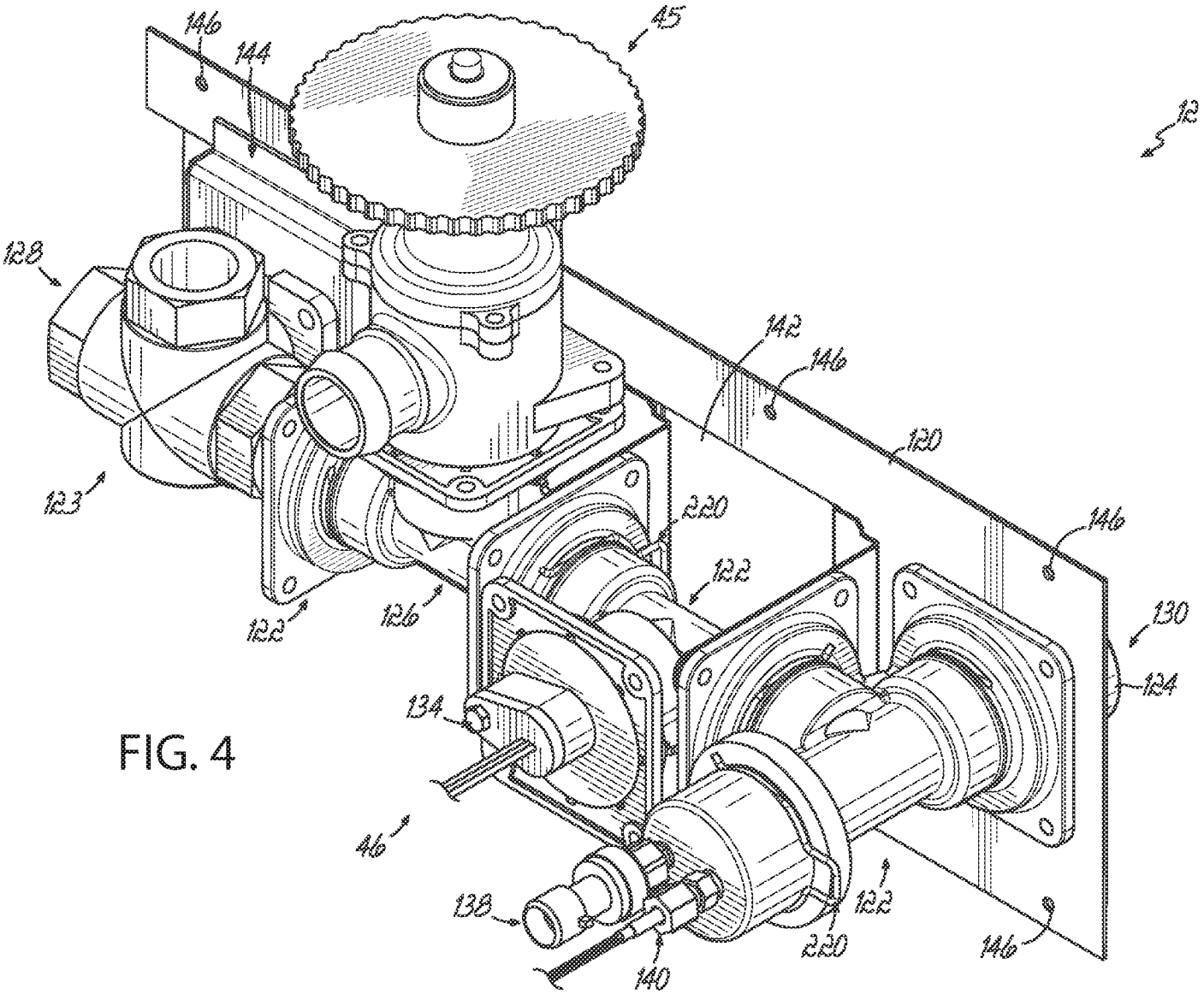
FIG. 4 is a perspective view of a configurable manifold system for use with the refrigerated process chiller of FIG. 1, illustrating a plurality of manifold blocks supporting respective components and being removably coupled together to form part of the manifold system in accordance with an embodiment of the present invention.

As shown in FIG. 4, each manifold block 122 is configured to support at least one component or sensing device, such as the pressure relieve valve 45, the flowmeter 46 in the form of a paddle wheel flowmeter 134, the check valve 48 (FIG. 17), a pressure transducer 138, and/or an RTD 140, such that part of the component 45, 48, 134, 138, 140 is placed in fluid contact with the fluid coolant 54 flowing through the fluid conduit 126 formed by the modular manifold system 12. While the exemplary manifold system 12 is illustrated with three manifold blocks 122, a flow control valve 123, and an interface fitting 124 fluidly coupled together in one configuration, it is understood that other manifold system configurations are possible having fewer or more manifold blocks 122 coupled together in different orientations to form a fluid conduit having a flow path with a geometry that is different from that shown in FIG. 4. It is also understood that fewer or more, or different types of components or sensing devices, may be used with the manifold blocks 122 as understood by those skilled in the art. To this end, the drawings are not intended to be limiting.

Figure 5:
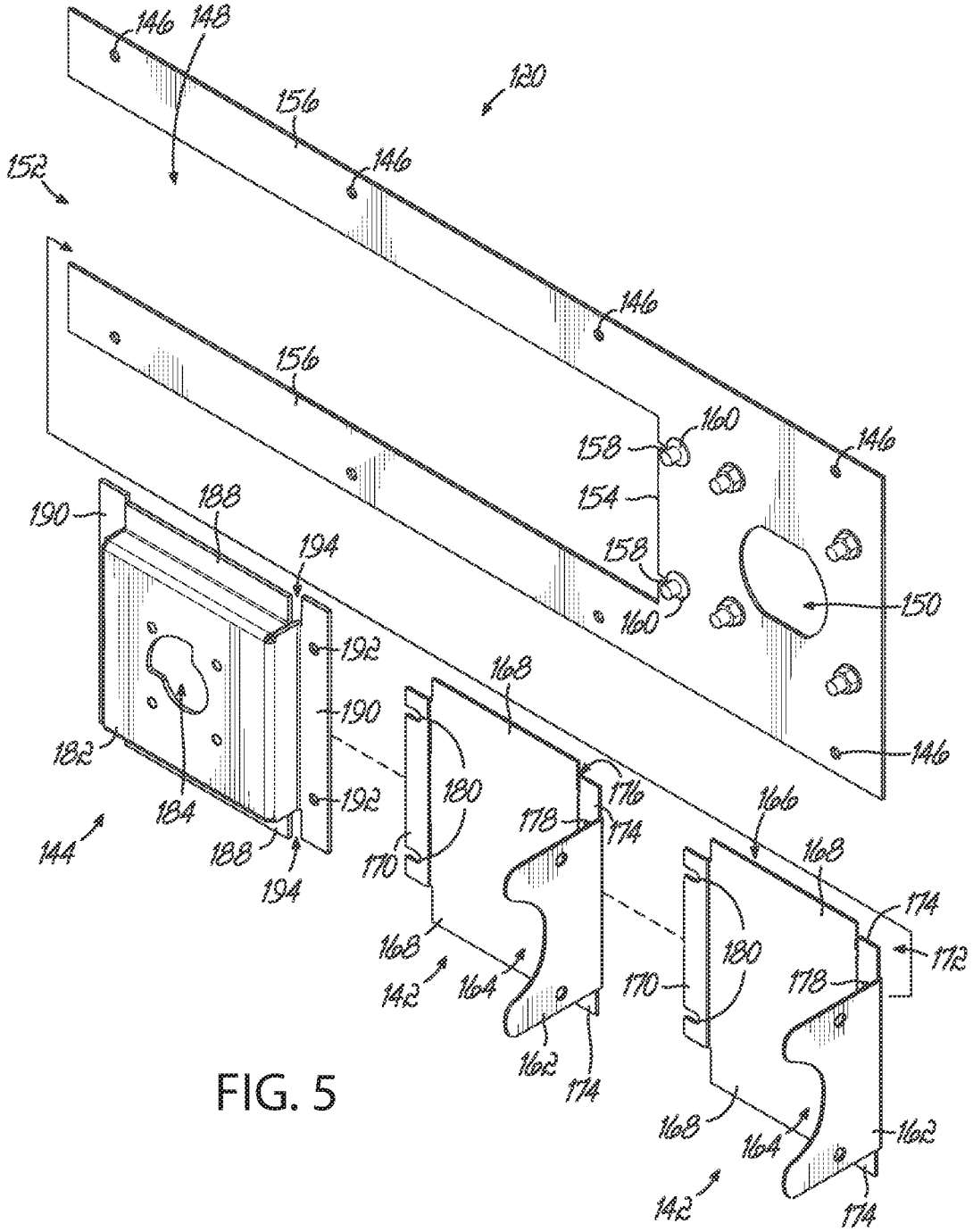
FIG. 5 is a disassembled perspective view of a support bracket of the manifold system of FIG. 4.
Figure 6:
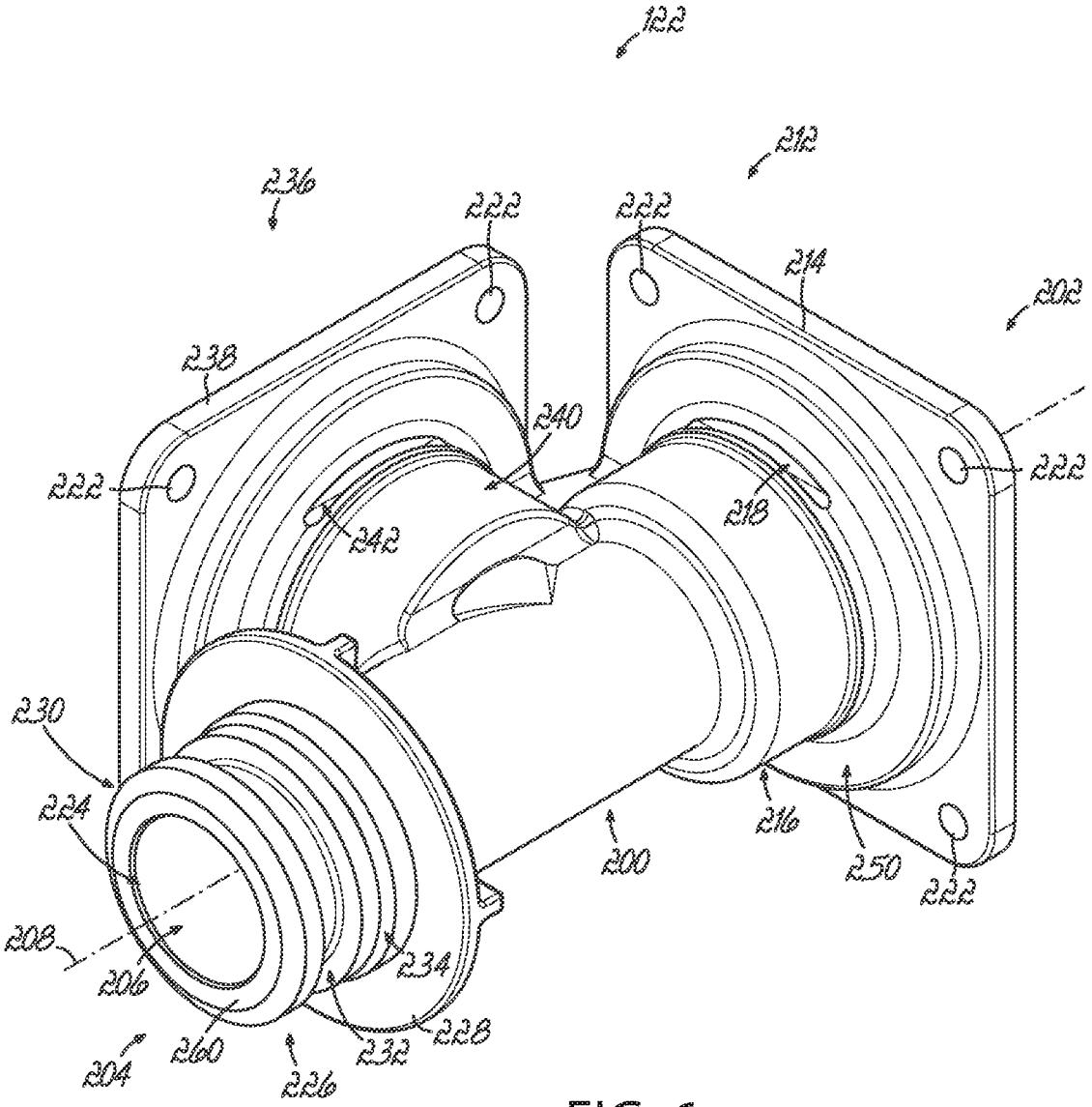
FIGS. 6-9 are perspective views of a manifold block of the manifold system of FIG. 4.
Figure 7:
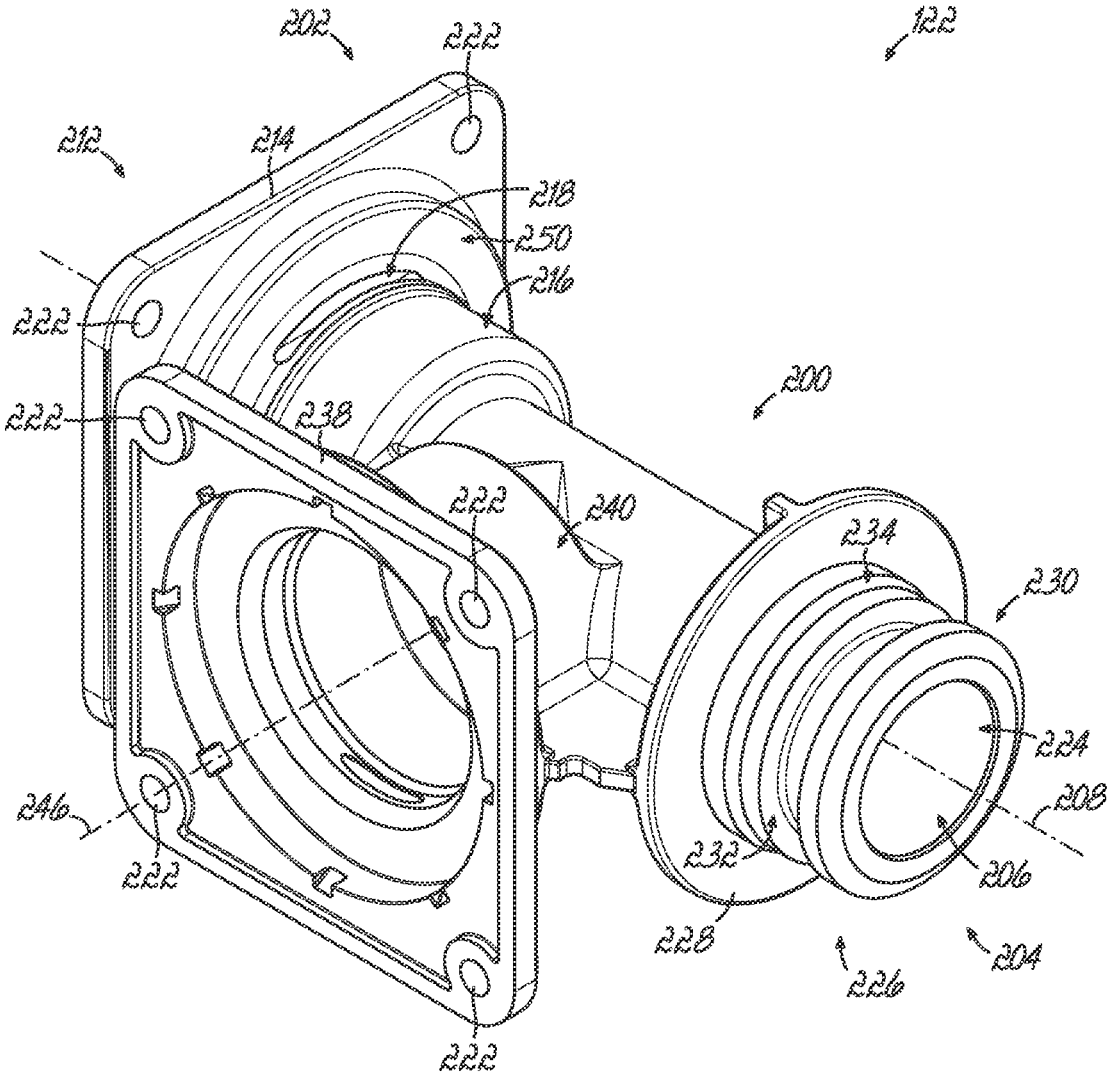
Figure 8:
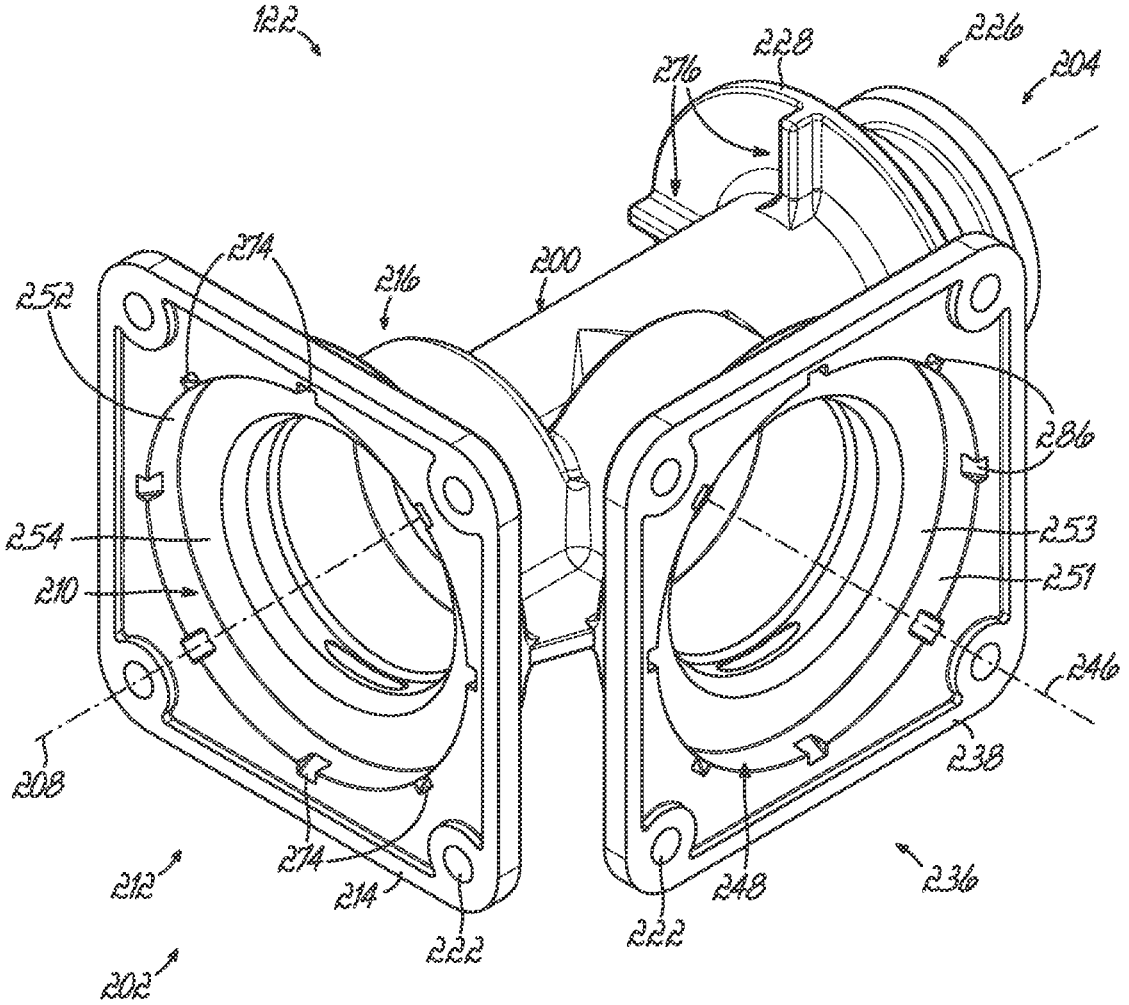

With reference to FIGS. 4 and 5, the support plate 120 is configured to support the manifold blocks 122, the flow control valve 123, and the interface fitting 124 so that the manifold system 12 may be fluidly connected to the fluid flow loop 26 within the chiller 10. More particularly, the support plate 120 includes one or more removable plates 142, each of which is configured to receive a corresponding manifold block 122 to thereby support the manifold block 122 from the support plate 120. The support plate 120 also includes at least one removable component bracket 144 configured to receive the flow control valve 123 to thereby support the control valve 123 from the support plate 120, as will be described in further detail below. When the chiller 10 is manufactured, the components of the manifold system 12, such as the manifold blocks 122, the flow control valve 123, and interface fitting 124 may be preassembled to the support plate 120 before the manifold system 12 is fluidly connected to the fluid flow loop 26 within the chiller 10. The support plate 120 includes a plurality of mounting bores 146 configured to receive mounting hardware to mount the support plate 120 to a surface within the chiller 10. For example, the support plate 120 may be mounted to an interior surface of the chiller 10, such as an interior surface of the back cover 18, for example. To this end, the interface fitting 124 may form the outlet port 66 of the fluid flow loop 26 to which the external fluid line 34 connects, for example.

With continued reference to FIGS. 4 and 5, the support plate 120 includes a U-shaped notch 148 configured to slideably receive the one or more removable plates 142 and the removable component bracket 144 therein, in an end-to-end arrangement, as shown in FIG. 4. The support plate 120 further includes an aperture 150 configured to receive a portion of the interface fitting 124 therethrough. As shown, the U-shaped notch 148 extends from an open end 152 of the support plate 120 to a base 154 near an opposite end of the support plate 120 to define two elongated support members 156. Each removable plate 142 and the removable component bracket 144 is secured between the two support members 156, as will be described in more detail below. The base 154 of the U-shaped notch 148 includes two slots 158 configured to receive appropriate fasteners 160, such as PEM® brand fasteners (commercially available from PennEngineering, Danboro, PA), screws, bolts, or other suitable fasteners, for example, for securing one of either a removable plate 142 or the removable component bracket 144 to the support plate 120. Once either a removable plate 142 or the component bracket 144 is secured to the base 154 of the U-shaped notch 148, each additional removable plate 142 or component bracket 144 is then coupled end-to-end within the notch 148 and secured between the two support members 156, as will be described in further detail below.

With continued reference to FIG. 5, each removable plate 142 is generally L-shaped and includes a bracket 162 configured to removably receive a part of a corresponding manifold block 122 to couple the manifold block 122 to the removable plate 142. The bracket 162 includes a U-shaped notch 164 configured to receive a portion of a respective manifold block 122 therein, as described in further detail below. Each plate 142 also includes a generally plate-like body that transitions from a first body portion 166 having a first pair of upper and lower tabs 168 and an end tab 170 to a second body portion 172 having a second pair of upper and lower tabs 174. The transition between the first body portion 166 and the second body portion 172 spaces the second pair of tabs 174 away from the first pair of tabs 168, in a vertical direction, to define a gap 176 therebetween. In this regard, when each plate 142 is positioned within the U-shaped notch 148, one support member 156 of the support plate 142 is positioned within the gap 176 between corresponding upper first and second tabs 168, 174 of the plate 142 while the other support member 156 is positioned within the gap 176 between corresponding lower first and second tabs 168, 174 to hold the support plate 120 between the two support members 156 and within the U-shaped notch 148. To this end, the first pair of upper and lower tabs 168 engage with a back surface of the support plate 120 and the second pair of upper and lower tabs 174 engage with a front surface of the support plate 120. This engagement permits sliding of each plate 142 within the u-shaped notch 148 in a first direction (e.g., a movement axis between the open end 152 and the base 154 of the notch 148), but prevents each support plate 120 from being pulled out of the U-shaped notch 148 in a transverse movement direction.

The second body portion 172 of each removable plate 142 includes a pair of bores 178 and the end tab 170 includes a pair of slots 180. The bores 178 and the slots 180 are correspondingly located such that the bores 178 of a first plate 142 may be aligned with the slots 180 of a second plate 142 to couple the two plates 142 together within the notch 148. In this regard, a first plate 142 is slideably received within the U-shaped notch 148 to position the second body portion 172 in an overlapping engagement with the base 154 of the U-shaped notch 148 to align the bores 178 and the slots 158 for receiving fasteners 160 used to secure the first plate 142 to the support plate 120. A second plate 142 is then slideably received within the U-shaped notch 148 and moved into an abutting position with the first plate 142 so as to be in an end-to-end arrangement with the first plate 142. More particularly, the second body portion 172 of the second plate 142 is in an overlapping arrangement with the end tab 170 of the first plate 142 to align the bores 178 of the second plate 142 with the slots 180 of the first plate 142 for receiving fasteners 160 used to secure the first plate 142 to the second plate 142. This process is repeated for each plate 142 positioned within the U-shaped notch 148 to couple the plate 142 to the support plate 120.

With continued reference to FIG. 5, the removable component bracket 144 includes a generally plate-like body 182 to which the flow control valve 123 is configured to be coupled, and an aperture 184 through which a handle 186 (FIG. 17) of the flow control valve 123 extends, as described in more detail below. The component bracket 144 further includes a pair of upper and lower tabs 188 and a pair of end tabs 190, the end tabs 190 each having a pair of bores 192 formed therein. The pair of upper and lower tabs 188 are raised or spaced apart, in a vertical direction, from the pair of end tabs 190 to define a gap 194 therebetween. Similar to the removable plates 142 described above, when the component bracket 144 is slideably positioned within the U-shaped notch 148, one support member 156 of the support plate 120 is positioned within the gap 194 between the upper tab 188 and the two end tabs 190 of the component bracket 144 while the other support member 156 is positioned within the gap 194 between lower tab 188 and the two end tabs 190 to thereby hold the component bracket 144 within the U-shaped notch 148 and between the two support members 156. To this end, a portion of the end tabs 190 engage with a back surface of the support plate 120 and the pair of upper and lower tabs 188 engage with a front surface of the support plate 120.

In the embodiment shown, the component bracket 144 is located at the open end 152 of the U-shaped notch 148 and is coupled to an adjacent removable plate 142 so as to be in an end-to-end arrangement with the two removable plates 142 positioned within the notch 148. In that regard, the end tab 170 of the plate 142 adjacent to the component bracket 144 is in an overlapping arrangement with a side tab 190 of the component bracket 144 to align the slots 180 in the end tab 170 of the adjacent plate 142 with the bores 192 in the end tab 190 of the component bracket 144 for receiving fasteners 160 used to secure the component bracket 144 to the plate 142. As best shown in FIG. 4, the component bracket 144 and each plate 142 are coupled together in an end-to-end arrangement, or a daisy chain, with the plate 142 nearest the base 154 of the notch 148 being coupled to the support plate 120 to prevent the arrangement from sliding out of the notch 148 and becoming disengaged with the support plate 120.

While FIG. 4 illustrates one end-to-end configuration of support plates 142 and a component bracket 144 within the notch 148 of the support plate 120, it is understood that other end-to-end configurations of support plates 142 and component brackets 144 are possible, depending on the desired configuration of the manifold system 12. The end-to-end arrangement illustrated in FIG. 4, starting from the base 154 of the U-shape notch 148, includes in sequence, a first removable plate 142, a second removable plate 142, and a component bracket 144. However, other arrangements may include the following end-to-end arrangements, starting from the base 154 of the U-shape notch 148 in sequence, (1) a component bracket 144, a first plate 142, and a second plate 142, or (2) a first plate 142, a component bracket 144, and a second plate 142. It is also understood that the support plate 120 may be larger or smaller to accommodate more or fewer support plates 142 or component brackets 144, for example.

Referring now to FIGS. 6-16, details of an exemplary manifold block 122 for use with the manifold system 12 will now be described in accordance with an embodiment of the present invention. The manifold block 122 is generally T-shaped and includes a tubular body 200 that extends between a first end 202 and an opposite second end 204 to define a first fluid passageway 206 having a first flow axis 208. As best shown in FIGS. 6-12, the first end 202 of the manifold block 122 includes a first opening 210 to the first fluid passageway 206 of the tubular body 200 that is defined by a first female union 212. The first female union 212 includes a first mounting flange 214 and a neck 216 that extends from the first mounting flange 214 in a direction along the first flow axis 208 toward the second end 204 of the tubular body 200. The neck 216 includes a pair of slots 218 each of which is configured to receive a portion of a spring clip 220 (e.g., FIG. 4) therein to couple the manifold block 122 to another, like manifold block 122, as will be described in further detail below. The first mounting flange 214 includes a plurality of bores 222 configured to receive appropriate mounting hardware, such as screws or bolts, for example, for mounting the manifold block 122 directly to the support plate 120 or a removable plate 142 of the support plate 120.

The second end 204 of the manifold block 122 includes a second opening 224 to the first fluid passageway 206 of the tubular body 200 that is defined by a male union 226. The male union 226 includes an annular flange 228 and a tubular connector 230 that extends from the annular flange 228 in a direction along the first flow axis 208 to the second end 204 of the tubular body 200. The tubular connector 230 includes a first annular groove 232 configured to receive a sealing gasket therein, such as an o-ring (not shown), and a second annular groove 234 configured to receive portions of a spring clip 220 therein to couple the manifold block 122 to another, like manifold block 122, or a component, as will be described in further detail below.

Figure 13:
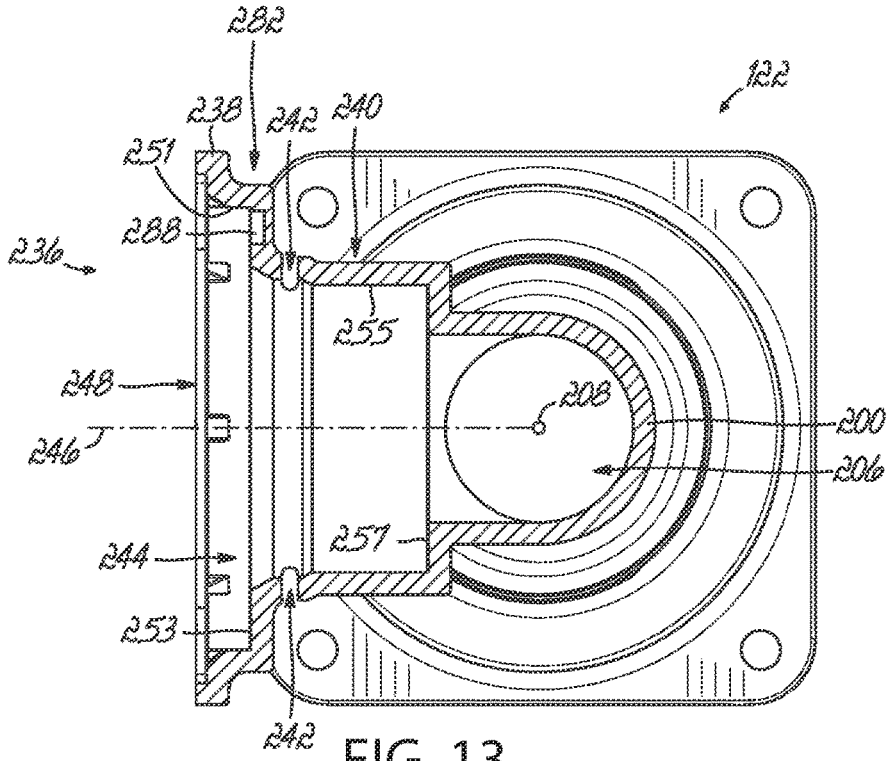
FIG. 13 is a front cross-sectional view of the manifold block of FIG. 12 taken along line 13-13.

With reference to FIGS. 6-9 and 13, the manifold block 122 includes a second female union 236 located generally at a midpoint along the tubular body 200 of the manifold block 122. The second female union 236 is defined by a second mounting flange 238 and a neck 240 that extends from the second mounting flange 238 in a direction toward the first fluid passageway 206 and to the tubular body 200. The neck 240 also includes a pair of slots 242 each of which is configured to receive a portion of a spring clip 220 therein to couple the manifold block 122 to another, like manifold block 122 or component. The second mounting flange 238 also includes a plurality of bores 222 configured to receive appropriate mounting hardware, such as screws or bolts, for example, for mounting the manifold block 122 to the support plate 120 or a removable plate 142 of the support plate 120, for example. As best shown in FIG. 13, the second female union 236 defines a second fluid passageway 244 in fluid communication with the first fluid passageway 206 of the tubular body 200. The second fluid passageway 244 defines a second flow axis 246 that is oriented transverse to the first flow axis 208. To this end, the second female union 236 defines an opening 248 to the second fluid passageway 244 of the manifold block 122 that is in fluid communication with the first fluid passageway 206 of the manifold block 122.

The configuration of the first and second female unions 212, 236 and the male union 226 of the manifold block 122 permit removable coupling of two or more manifold blocks 122 together to form part of the fluid conduit 126 of the manifold system 12. More particularly, as shown in FIG. 4, the first and second female unions 212, 236 of each manifold block 122 are each configured to selectively receive the male union 226 of a second manifold block 122, to fluidly couple the manifold blocks 122 together such that the first or second fluid passageways 206, 244 of the manifold block 122 and the first or second fluid passageways 206, 244 of the second manifold block 122 form part of the fluid conduit 126 of the manifold system 12. To this end, the first and second female unions 212, 236 are each shaped to receive the male union 226 therein, as described in further detail below.

Figure 9:
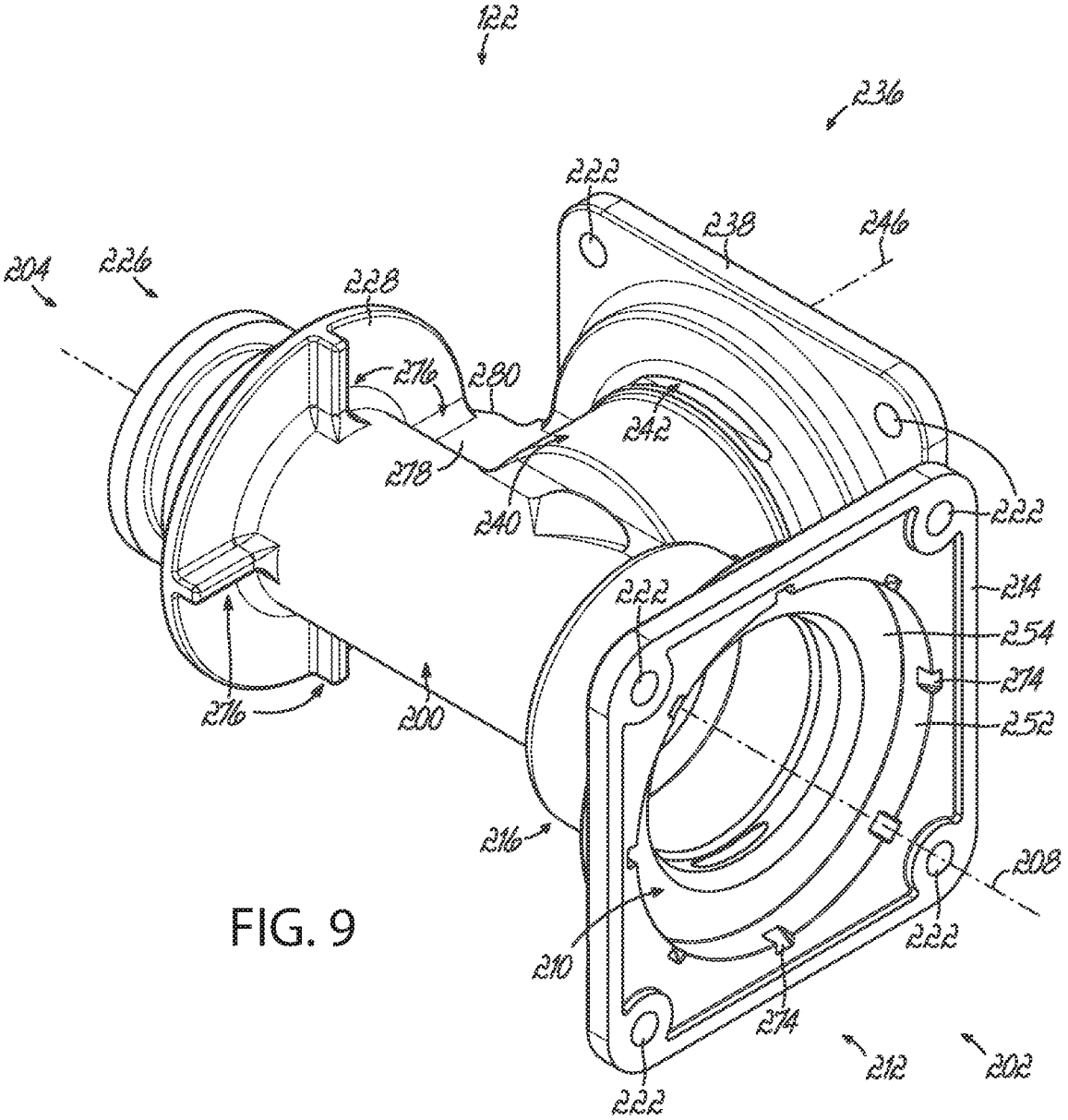
Figure 10:
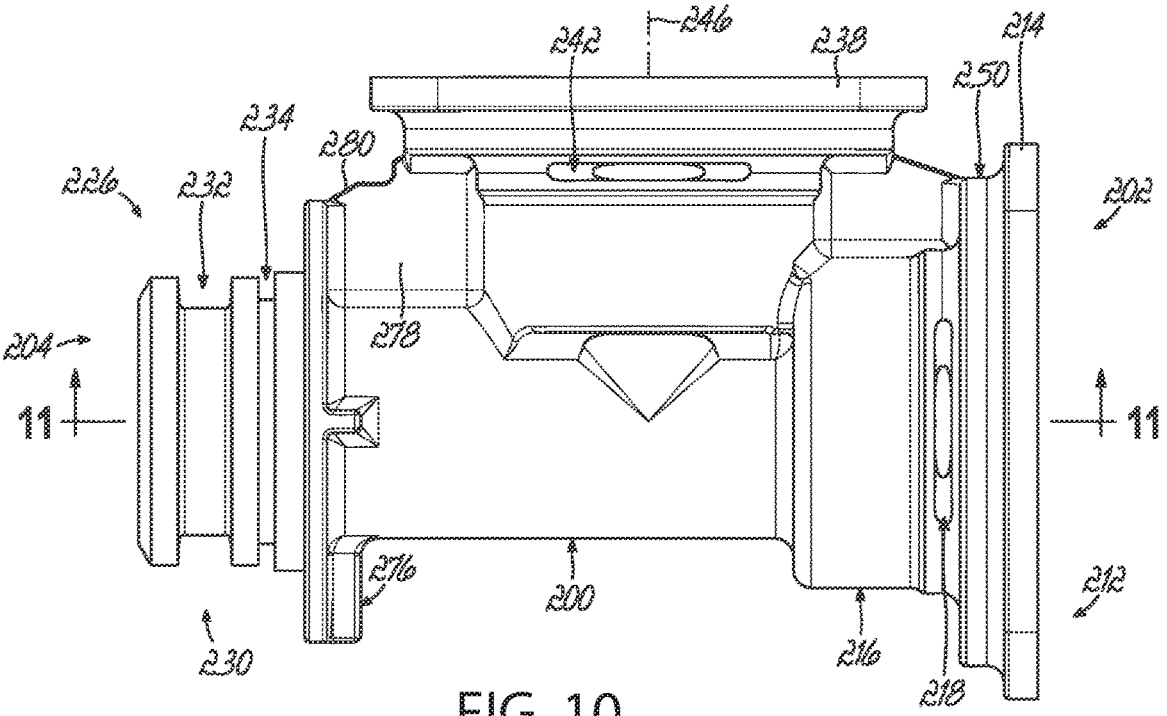
FIG. 10 is a top view of the manifold block of FIGS. 6-9.
Figure 11:
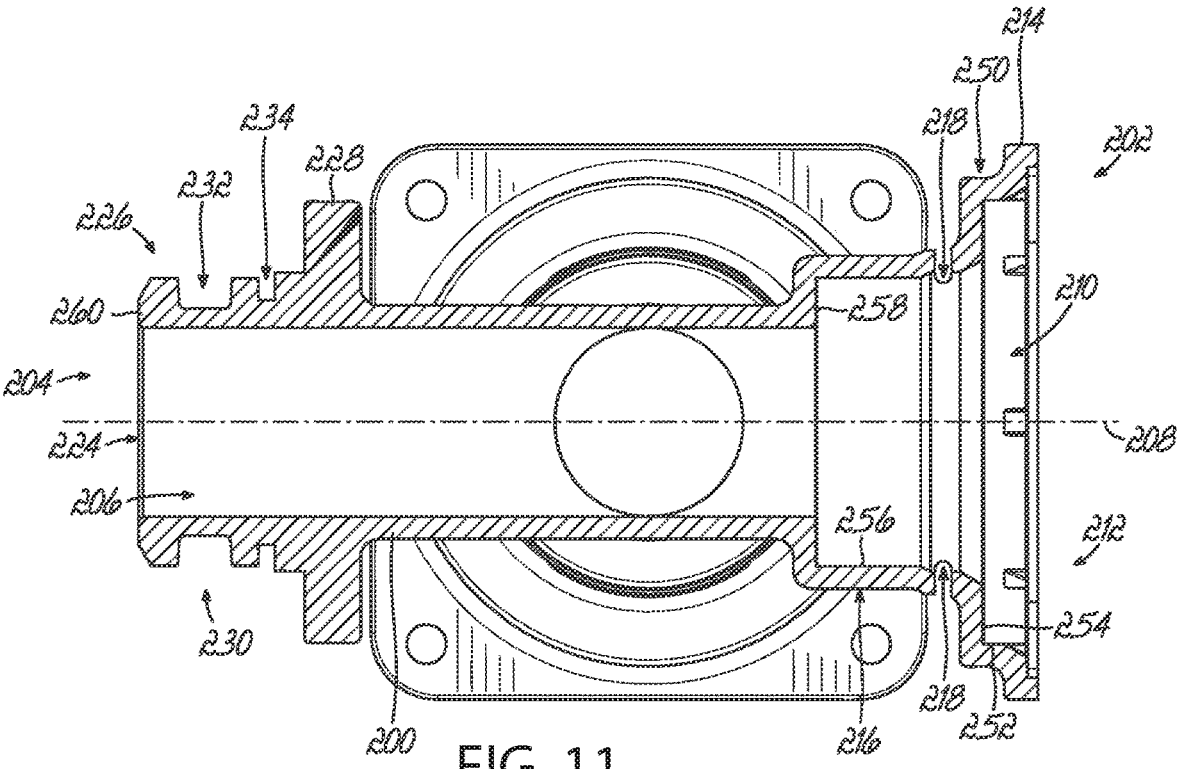
FIG. 11 is a side cross-sectional view of the manifold block of FIG. 10 taken along line 11-11.
Figure 12:
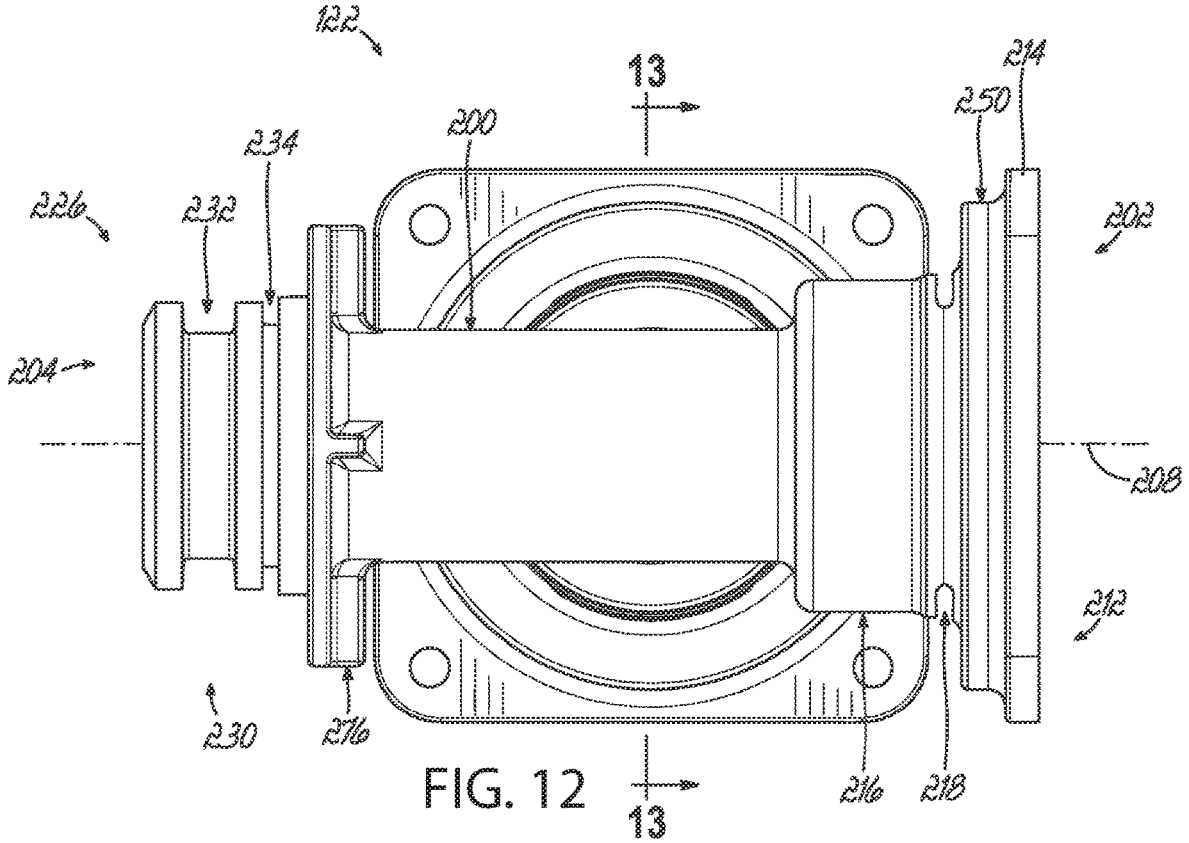
FIG. 12 is a side view of the manifold block of FIGS. 6-11.
Figure 14:
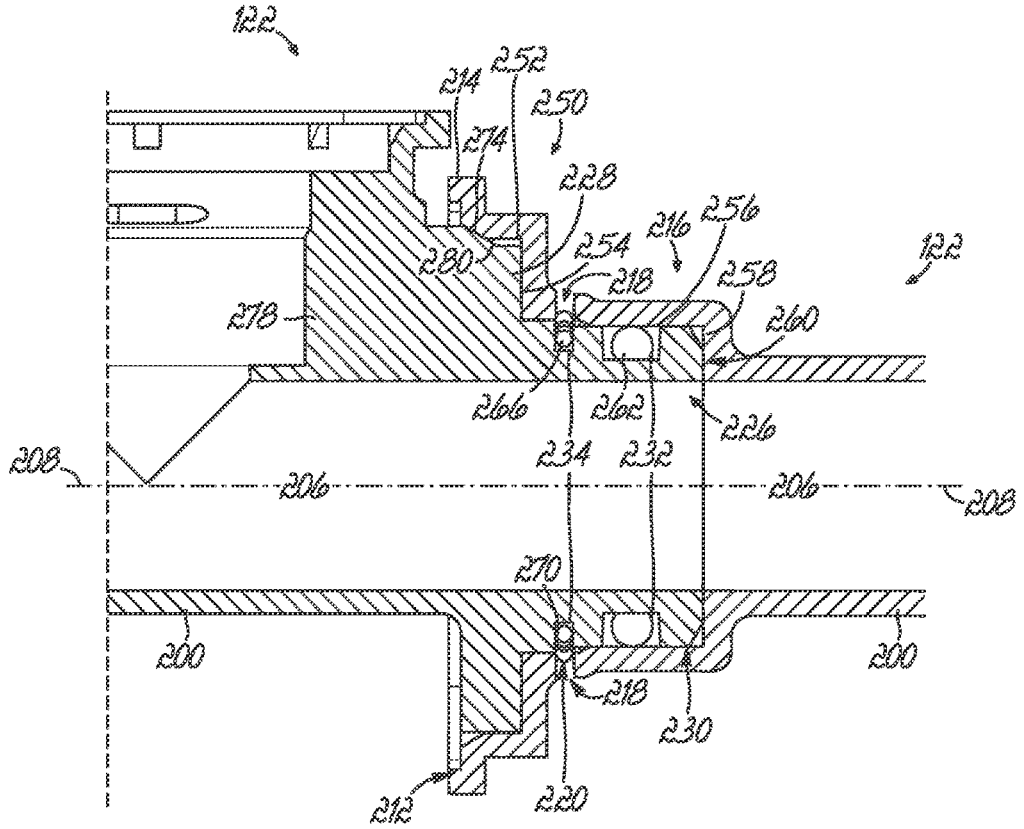
FIG. 14 is a cross-sectional view of a fluid engagement between two manifold blocks, illustrating a male union of a first manifold block coupled to a first female union of a second manifold block in a tool-less manner.

Referring now to FIGS. 8-12, the first opening 210 to the first fluid passageway 206 that is defined by the first female union 212 of the manifold block 122 has a generally stepped profile that reduces in size in a direction from the mounting flange 214, where a diameter of the opening 210 is the largest, to the tubular body 200, where a diameter of the opening 210 is the smallest. In this regard, the neck 216 of the first female union 212 defines the smaller diameter of the opening and an enlarged portion 250 of the neck 216 adjacent to the flange 214 defines the larger diameter of the opening 210. As best shown in FIG. 11, the enlarged portion 250 of the neck 216 defines a first annular wall 252 and a first annular shoulder 254 and the neck 216 defines a second annular wall 256 and a second annular shoulder 258. The stepped profile of the first female union 212 corresponds to a generally stepped profile of the male union 226 defined by the transition between the annular flange 228 and the tubular connector 230. In this regard, the male union 226 of a first manifold block 122 is configured to be received within the first female union 212 of a second manifold block 122. When so positioned, as shown in FIG. 14, the tubular connector 230 is received within the neck 216 of the first female union 212 and the annular flange 228 is received within the enlarged portion 250 of the neck 216. More particularly, an annular tip 260 of the tubular connector 230 is in an abutting or near abutting relationship with the second shoulder 258 of the neck 216, and the annular flange 228 of the male union 226 is engaged with the first annular shoulder 254 of the enraged portion 250 of the neck 216. To this end, a gasket 262 such as an o-ring, for example, forms a seal between the tubular connector 230 and the second annular wall 256 of the neck 216. As shown in FIG. 14, the engagement between the two manifold blocks 122 places the first fluid passageway 206 of the first manifold block 122 in direct fluid communication with the first fluid passageway 206 of the second manifold block 122 such that the first flow axes 208 are coaxial.

Figure 17:
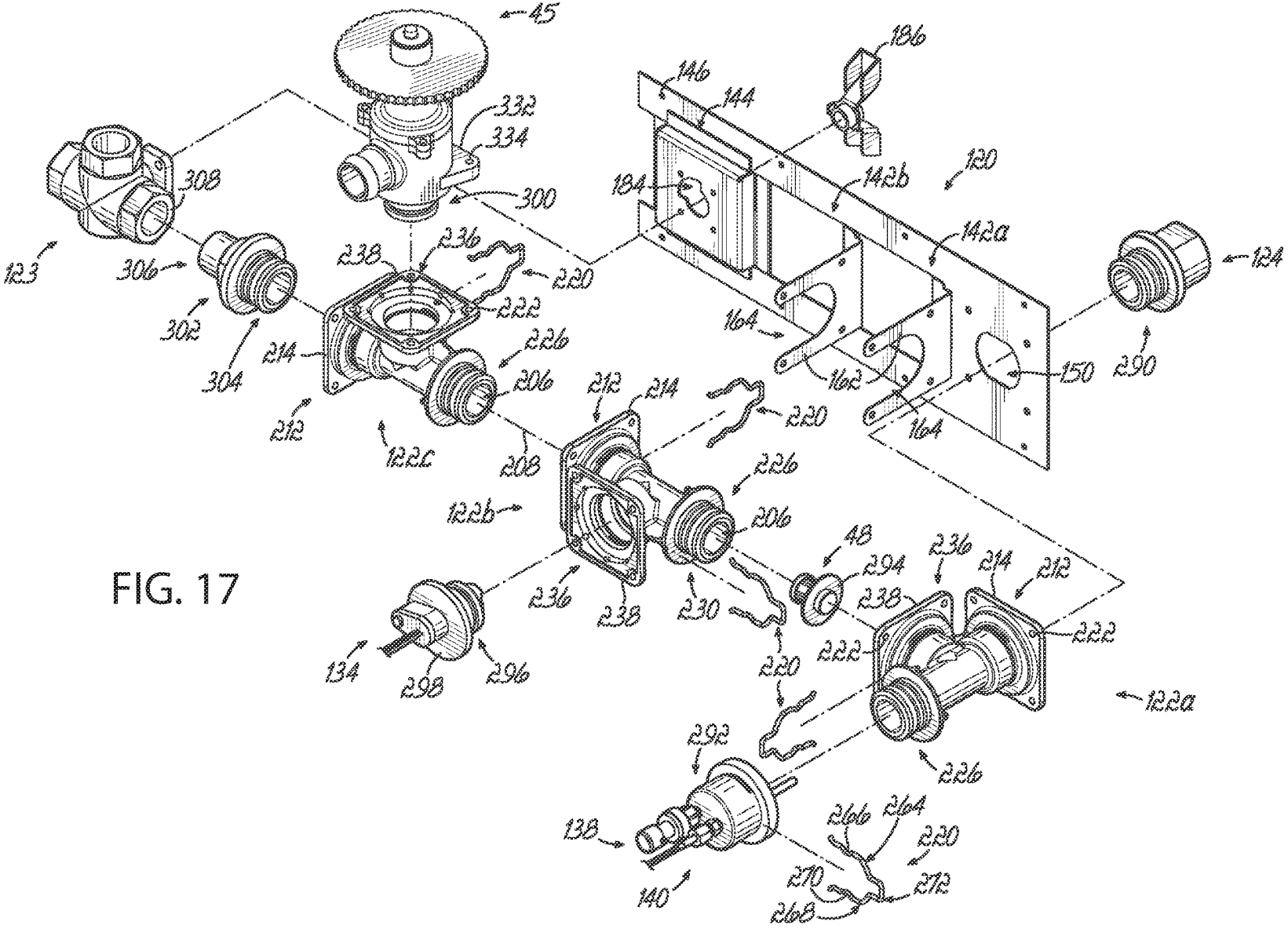
FIG. 17 is an exploded perspective view of the configurable manifold system of FIG. 4.

As briefly described above, the first and second manifold blocks 122 are configured to be removably coupled together with a spring clip 220. As best shown in FIG. 17, each spring clip 220 is generally U-shaped with a first leg 264 with a first bowed portion 266 and a second leg 268 with a second bowed portion 270. The spring clip 220 also includes a tab portion 272 configured to be gripped by a user to insert or remove the spring clip 220 from a manifold block 122, for example. Returning to FIG. 14, when the male union 226 of one manifold block 122 is received within the first female union 212 of a second manifold block 122, the second annular groove 234 of the tubular connector 230 is aligned with the pair of slots 218 in the neck 216 of the first female union 212. When so positioned, a spring clip 220 is pressed into engagement with aligned annular groove 234 and slots 218 to couple the manifold blocks 122 together, as shown. More particularly, the first bowed portion 266 of the spring clip 220 is received within a first slot 218 and the annular groove 234 and the second bowed portion 270 of the spring clip 220 is received within a second slot 218 and the annular groove 234. To this end, the bowed portions 266, 270 are in a confronting relationship with side walls of the annular groove 234 to thereby prevent the male union 226 from becoming disengaged with the first female union 212.

Referring again to FIGS. 8-12, the first female union 212 includes a plurality of first indexing features 274, each of which is configured to properly orient a component or another manifold block 122 attached to the first female union 212. The plurality of first indexing features 274 can be notches. The plurality of first indexing 274 features also permit incremental rotational indexing of a component or another manifold block 122 relative to the first female union 212. The plurality of first indexing features 274 are generally formed in the first annular wall 252 of the enlarged neck portion 250 and extend angularly between the first annular wall 252 and the first mounting flange 214. As shown, the first female union 212 includes eight indexing features 274 spaced apart about a circumference of the first annular wall 252 in 45° increments. However, the first female union 212 may include more or less indexing features 274 that are spaced apart in greater or smaller increments about the circumference of the first annular wall 252, such as sixteen indexing features 274 spaced apart in 22.5° increments, or four indexing features 274 spaced apart in 90° increments, for example.

With continued reference to FIGS. 8-12, the male union 226 also includes a plurality of splines 276 formed on the annular flange 228 of the male union 226 and being spaced apart circumferentially about the annular flange 228. Each spline 276 generally extends from the tubular body 200 of the manifold block 122 to a periphery of the annular flange 228. As best shown in FIGS. 9-10, one of the plurality of splines 276 includes a gusset 278 that extends between the annular flange 228 of the male union 226 and the neck 240 of the second female union 236. The gusset 278 functions as an indexing feature configured to be received within a corresponding first indexing feature 274 of the first female union 212 to properly orient a first manifold block 122 relative to a second manifold block 122 for attachment thereto. As shown, the gusset 278 includes an angled portion 280 that extends beyond the outer periphery of the annular flange 228 of the male union 226. To this end, the angled portion 280 generally corresponds to the first indexing feature 274 formed in the neck 216 of the first female union 212.

When the male union 226 of a first manifold block 122 is coupled to the first female union 212 of a second manifold block 122, as shown in FIG. 14, the gusset 278, and more particularly the angled portion 280 of the gusset 278, is engaged with a corresponding indexing feature 274. In this regard, the angled portion 280 of the gusset 278 may effectively function as key and each indexing feature 274 may effectively function as a keyway. The engagement between the gusset 278 and each indexing feature 274 provides the first manifold block 122 with multiple selectable rotational orientations relative to the second manifold block 122. In this regard, the gusset 278 permits the first manifold block 122 to be incrementally indexed, rotationally, relative to the second manifold block 122. More particularly, the first manifold block 122 may be indexed rotationally, in 45° increments relative to the second manifold block 122, as a result of the spacing of the first indexing features 274 of the first female union 212 of the second manifold block 122.

With reference to FIGS. 6-10 and 13, the second female union 236 is also configured to receive the male union 226 of a like, second manifold block 122, to fluidly couple the manifold blocks 122 together, as shown in FIG. 4. In this regard, the configuration of the second female union 236 is similar in many respects to the configuration of the first female union 212 described above. More particularly, the opening 248 to the second fluid passageway 244 that is defined by the second female union 236 of the manifold block 122 has a generally stepped profile that reduces in size in a direction from the second mounting flange 238, where a diameter of the opening 248 is the largest, to the tubular body 200, where a diameter of the opening 248 is the smallest. More particularly, the neck 240 of the second female union 236 defines the smaller diameter of the opening 248 and an enlarged portion 282 of the neck 240 adjacent to the flange 238 defines the larger diameter of the opening 248. As best shown in FIG. 13, the enlarged portion 282 of the neck 240 defines a first annular wall 251 and a first annular shoulder 253 and the neck 240 defines a second annular wall 255 and a second annular shoulder 257. The stepped profile of the second female union 236 generally corresponds to the profile of the tubular connector 230 and the annular flange 228 of the male union 226. However, a size of the neck 240 of the second female union 236 (e.g., a height of the second annular wall 255 measured between the second annular shoulder 257 and the enlarged portion 282 of the neck 240) may be different compared to a size of the neck 216 of the first female union 212. In this regard, the neck 240 of the second female union 236 is larger compared to the neck 216 of the first female union 212 to accommodate larger components, or a component located between the male union 226 and the second female union 236, such as the check valve 48, for example, as will be described in further detail below.

Figure 15:
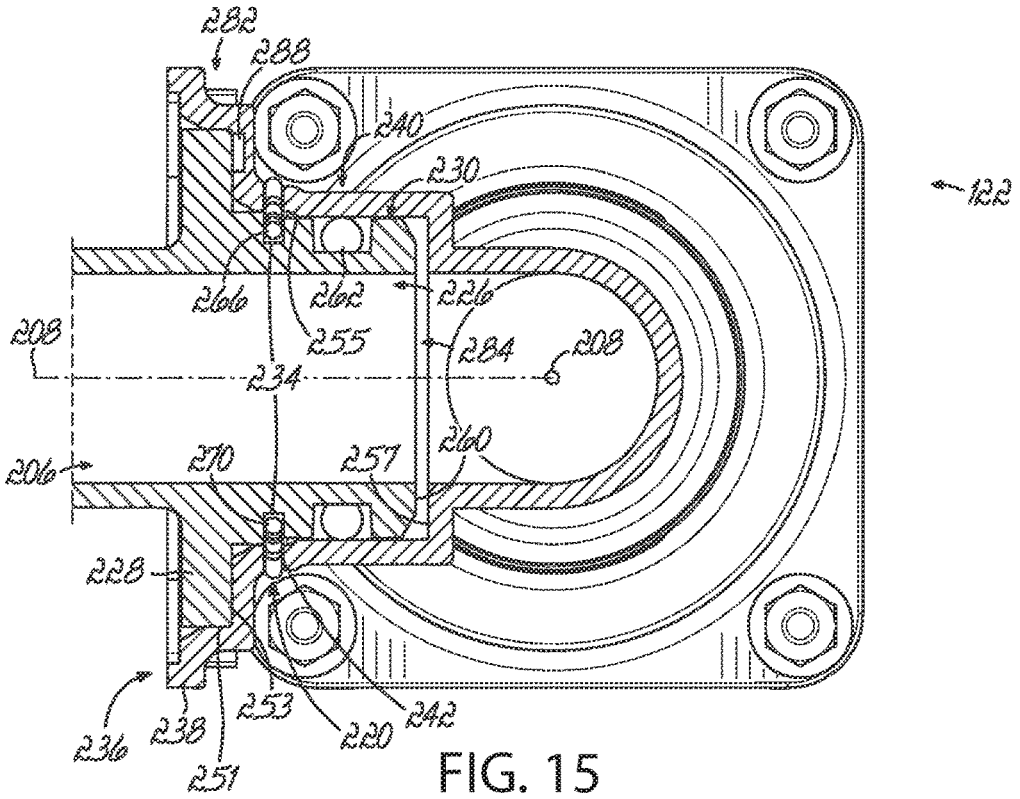
FIG. 15 is a cross-sectional view of a fluid engagement between two manifold blocks, illustrating a male union of a first manifold block coupled to a second female union of a second manifold block in a tool-less manner.

FIG. 15 illustrates the male union 226 of a first manifold block 122 engaged with the second female union 236 of a second manifold block 122 to couple the two manifold blocks 122 together. As shown, the tubular connector 230 is received within the neck 240 of the second female union 236 and the annular flange 228 is received within the enlarged portion 282 of the neck 240. The annular tip 260 of the tubular connector 230 is in a near abutting relationship with the second annular shoulder 257 such that a gap 284 is formed between the annular tip 260 of the tubular connector 230 and the second annular shoulder 257. As shown, the annular flange 228 of the male union 226 is engaged with the first annular shoulder 253 of the enlarged portion 282 of the neck 240. To this end, the o-ring 262 forms a seal between the tubular connector 230 and the second annular wall 255 of the neck 240. The engagement between the two manifold blocks 122 places the first fluid passageway 206 of the first manifold block 122 in direct fluid communication with the second fluid passageway 244 of the second manifold block 122 such that the first flow axis 208 of the first manifold block 122 and the second flow axis 246 of the second manifold block 122 are coaxial. The male union 226 of the first manifold block 122 is also coupled to the second female union 236 of the second manifold block 122 with a spring clip 220, as shown in FIG. 15. In this regard, the spring clip 220 is pressed into engagement with the aligned second annular groove 234 of the tubular connector 230 and the slots 242 formed in the neck 240 of the second female union 236 to couple the manifold blocks 122 together, as shown. More particularly, the first bowed portion 266 of the spring clip 220 may be received within the first slot 242 and the second annular groove 234 and the second bowed portion 270 of the spring clip 220 may be received within the second slot 242 and the annular groove 234 to prevent the male union 226 from becoming disengaged with the second female union 236.

Referring again to FIGS. 6-10 and 13, the second female union 236 also includes a plurality of first indexing features 286. The plurality of first indexing features 286 are similar to the plurality of first indexing features 274 described above with respect to the first female union 212 and are also each configured to receive the gusset 278 of the male union 226 for indexing and alignment of another manifold block 122, for example. The plurality of first indexing features 286 can be notches. In that regard, the plurality of first indexing features 286 are generally formed in the first annular wall 251 of the enlarged neck portion 282 and extend angularly between the first annular wall 251 and the second mounting flange 238. As shown, the second female union 236 also includes eight indexing features 286 spaced apart about a circumference of the first annular wall 251 in 45° increments. However, the second female union 236 may include more or less indexing features 286 that are spaced apart in greater or smaller increments about the circumference of the first annular wall 251, such as sixteen indexing features 286 spaced apart in 22.5° increments, or four indexing features 286 spaced apart in 90° increments, for example.

Figure 16:
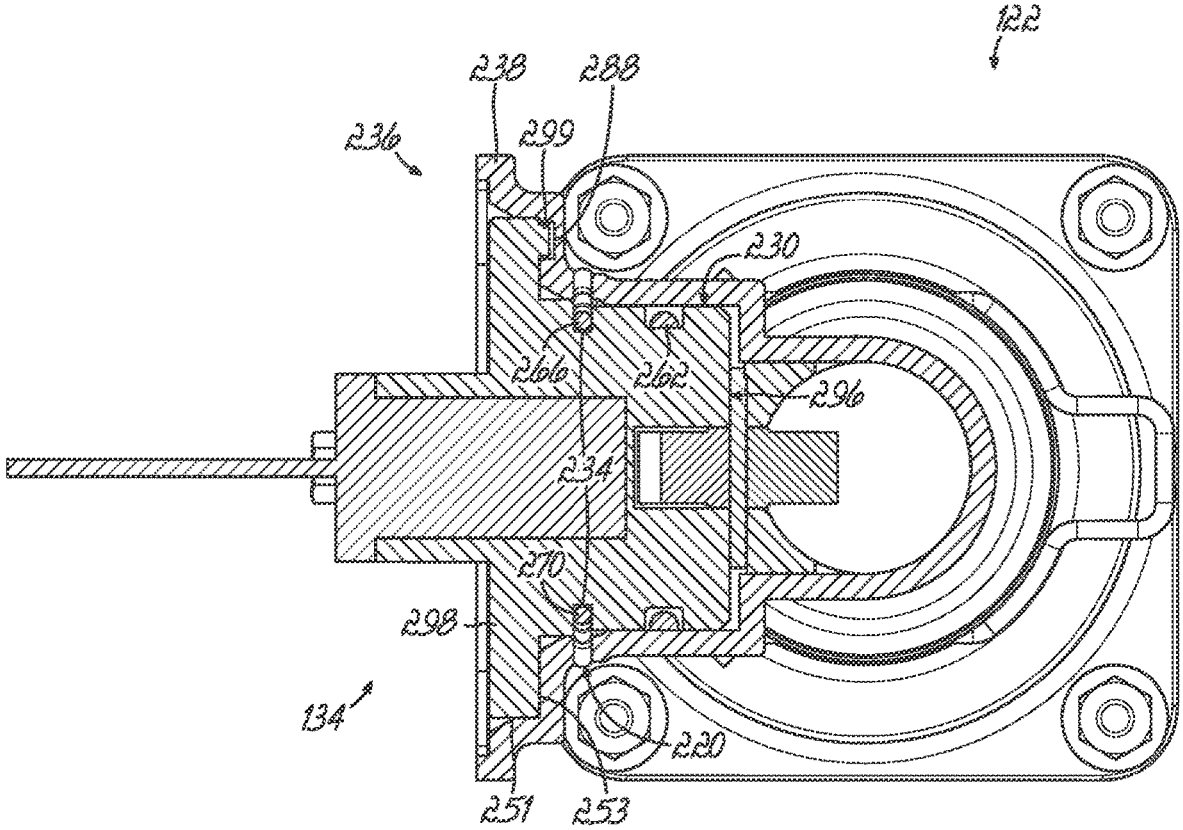
FIG. 16 is a cross-sectional view of a fluid engagement between a manifold block and a component, illustrating a male union of the component coupled to a second female union in the manifold block in a tool-less manner.

As best shown in FIGS. 13 and 16, the second female union 236 also includes at least one second indexing feature 288 configured to provide positive alignment to components attached to the second female union 236 that require a specific orientation. This type of positive alignment of components is also referred to by those skilled in the art as Poke-Yoke. For example, it is important to ensure that the flowmeter 134 is properly oriented within the fluid flow path through the manifold system 12. As shown, the second indexing feature 286 is formed as a blind bore in the first annular shoulder 253 of the second female union 236.

In a preferred embodiment, the manifold block 122 described above may be formed through a molding process, such as an injection molding process, using a suitable engineering material. For example, the manifold block 122 may be formed from Polyphenylene Sulfide (PPS) compound such as Ryton® R-4 or other suitable engineered thermoplastic. However, it will be recognized that other processes and materials are also possible.

According to one embodiment of the present invention, the manifold block 122 may be manufactured using a three-dimensional (3D) printing manufacturing method. The term "three-dimensional printing" or "additive manufacturing" or "rapid prototyping" refers to a process of making a three-dimensional solid object of virtually any shape from a digital model. 3D printing of the manifold block 122 is achieved using an additive process, where successive layers of material are laid down in different shapes to build the structures that define the manifold block 122. The term 3D printing, as used herein, may refer to methods such as, but not limited to, selective laser melting (SLM), direct metal laser sintering (DMLS), selective laser sintering (SLS), fused deposition modeling (FDM), and stereolithography (SLA). Further, any type of 3D printing machine that can print the materials described herein may be used. In this regard, computer-readable program instructions stored in a computer-readable medium may be used to direct a computer of a 3D printing machine, other types of programmable data processing apparatuses, or other devices to function in a particular manner, such that the instructions stored in the computer-readable medium produce an article of manufacture including instructions that implement the functions, acts, or operations specified in the flowcharts, sequence diagrams, or block diagrams used to 3D print the manifold block 122. The computer program instructions may be provided to one or more processors of a general purpose computer, a special purpose computer, or other programmable data processing apparatus to produce a machine, such that the instructions, which execute via the one or more processors, cause a series of computations to be performed to implement the functions, acts, or operations specified in the text of the specification, flowcharts, sequence diagrams, or block diagrams. Once the 3D printing machine has been provided with a model or computer-readable program instructions suitable for use in manufacturing the manifold block 122, the 3D printing machine may be operated to lay down successive layers of the desired material to build the manifold block 122 on a suitable substrate.

FIG. 17 shows the manifold system 12 of FIG. 4, except in an exploded perspective view to illustrate additional details of how components of the manifold system 12 are fluidly coupled together. In that regard, and with reference to FIGS. 17 and 4, the manifold system 12 includes three manifold blocks 122 (a first manifold block 122*a*, a second manifold block 122*b*, and a third manifold block 122*c*, as shown in FIG. 17), the flow control valve 123, and the interface fitting 124 which are configured to be removably coupled together and supported by the support plate 120 to form the fluid conduit 126 for fluid flow through the manifold system 12 as described above. More particularly, the first manifold block 122*a* is coupled to the support plate 120 via the first mounting flange 214 of the first female union 212. The second female union 236 of the first manifold block 122*a* is coupled to the bracket 162 of the first removable plate 142*a*. The first manifold block 122*a* is coupled to the support plate 120 with the first female union 212 aligned with the aperture 150 formed in the support plate 120. The interface fitting 124 is received through the aperture 150 and coupled to the first female union 212 to secure the interface fitting 124 to the support plate 120 such that the interface fitting 124 forms part of the fluid conduit 126 of the manifold system 12. The interface fitting 124 includes a male union 290 having a similar configuration compared to the male union 226 described above with respect to the manifold block 122 such that the interface fitting 124 may be fluidly coupled to the first female union 212 of the first manifold block 122*a* with a spring clip 220. The male union 226 of the first manifold block 122*a* includes is a component fitting 292 configured to couple the pressure transducer 138 and the RTD 140 to the first manifold block 122*a*. The component fitting 292 may have a similar configuration compared to the neck 216, 240 of the first or the second female unions 212, 236 to form a fluid connection with the male union 226 of the first manifold block 122*a* to thereby position the pressure transducer 138 and the RTD 140 within the fluid flow path through the fluid conduit 126 of the manifold system 12. To this end, the component fitting 292 is removably coupled to the male union 226 of the first manifold block 122*a* with a spring clip 220.

The second manifold block 122*b* is coupled to the first manifold block 122*a* and supported from the support plate 120 by the bracket 162 of the second removable plate 142*b*. The male union 226 of the second manifold block 122*b* is positioned through the U-shaped notch 164 of the first removable plate 142*a* and is removably coupled to the second female union 236 of the first removable block 122*a* with a spring clip 220. In this regard, the first fluid passageway 206 of the second manifold block 122*b* is in fluid communication with the second fluid passageway 244 of the first manifold block 122*a*. As shown, the check valve 48 is sandwiched between the male union 226 of the second manifold block 122*b* and the second female union 236 of the first manifold block 122*b*. More particularly, the check valve 48 includes an annular flange 294 configured to be located within the gap 284 between the annular tip 260 of the tubular connector 230 and the second annular shoulder 257 (FIG. 15). To this end, the check valve 48 is located within the fluid flow path through the fluid conduit 126 of the manifold system 12 to prevent backflow through the fluid flow loop 26, for example. The first female union 212 of the second manifold block 122*b* is coupled to the bracket 162 of the second removable plate 142*b*.

The flowmeter 134, which may be a paddle wheel flowmeter, for example, is coupled to the second female union 212 of the second manifold block 122*b* to thereby position part of the flowmeter 134 within the fluid flow path through the fluid conduit 126 of the manifold system 12. As shown, the flowmeter 134 includes a male union 296 having a similar configuration compared to the male union 226 described above with respect to the manifold block 122 such that the flowmeter 134 may be coupled to the second female union 236 with a spring clip 220, as shown in FIG. 16. As shown, the flowmeter 134, and more particularly an annular flange 298 of the male union 296 may include a positive alignment feature 299 that corresponds to the second indexing feature 288 formed in the first annular shoulder 253 of the second female union 236. To this end, the positive alignment feature is a projection configured to fit within the blind bore formed in the first annular shoulder 253 of the second female union 236, for example.

The third manifold block 122*c* is coupled between the second manifold block 122*b* and the flow control valve 123. As shown, the male union 226 of the third manifold block 122*c* is positioned through the U-shaped notch 164 of the second removable plate 142*b* and is removably coupled to the first female union 212 of the second manifold block 122*b* with a spring clip 220. In that regard, first fluid passageway 206 of the third manifold block 122*c* is in fluid communication with the first fluid passageway 206 of the second manifold block 122*b*. As shown, the third manifold block 122*c* is rotationally indexed 90° relative to the second manifold block 122*b*, in a direction about a common first flow axis 208, to position the second female union 236 in a vertical, upwardly facing position, to support the pressure relief valve 45. In that regard, the pressure relief valve 45 is fluidly coupled to the second female union 236. As described in further detail below, the pressure relief valve 45 includes a male union 300 having a similar configuration compared to the male union 226 described above with respect to the manifold block 122 such that the pressure relief valve 45 may be fluidly coupled to the second female union 236 with a spring clip 220.

The third manifold block 122*c* is coupled to the flow control valve 123 via an adapter 302. As shown, the adapter 302 includes a male union 304 at one end and a pipe stub 306 at the opposite end. The male union 304 of the adapter 302 has a similar configuration compared to the male union 226 described above with respect to the manifold block 122 so that the adapter 302 can be fluidly coupled to the first female union 212 of the third manifold block 122*c*. The pipe stub 306 of the adapter 302 is configured to be received within a compression fitting 308 of the flow control valve 123 to fluidly couple the third manifold block 122*c* to the flow control valve 123.

The flow control valve 123 is coupled to the removable component bracket 144 of the support plate 120 such that a valve stem (not shown) is aligned through the aperture 184 to operatively receive the valve handle 186. The aperture 184 permits movement of the handle 186 to operate the flow control valve 123 between an opened position, a closed, or another position to redirect fluid flow through the 3-way port of the flow control valve 123. To this end, the interface fitting 124, first manifold block 122*a*, second manifold block 122*b*, third manifold block 122*c*, adapter 302, and the flow control valve 123 are fluidly coupled together to form the fluid conduit 126 for fluid flow through the manifold system 12 with each of the manifold blocks 122 (122*a*, 122*b*, 122*c* in FIG. 17) supporting a respective component within the fluid flow path through the fluid conduit 126 of the manifold system 12, as shown in FIG. 4.

Figure 18:
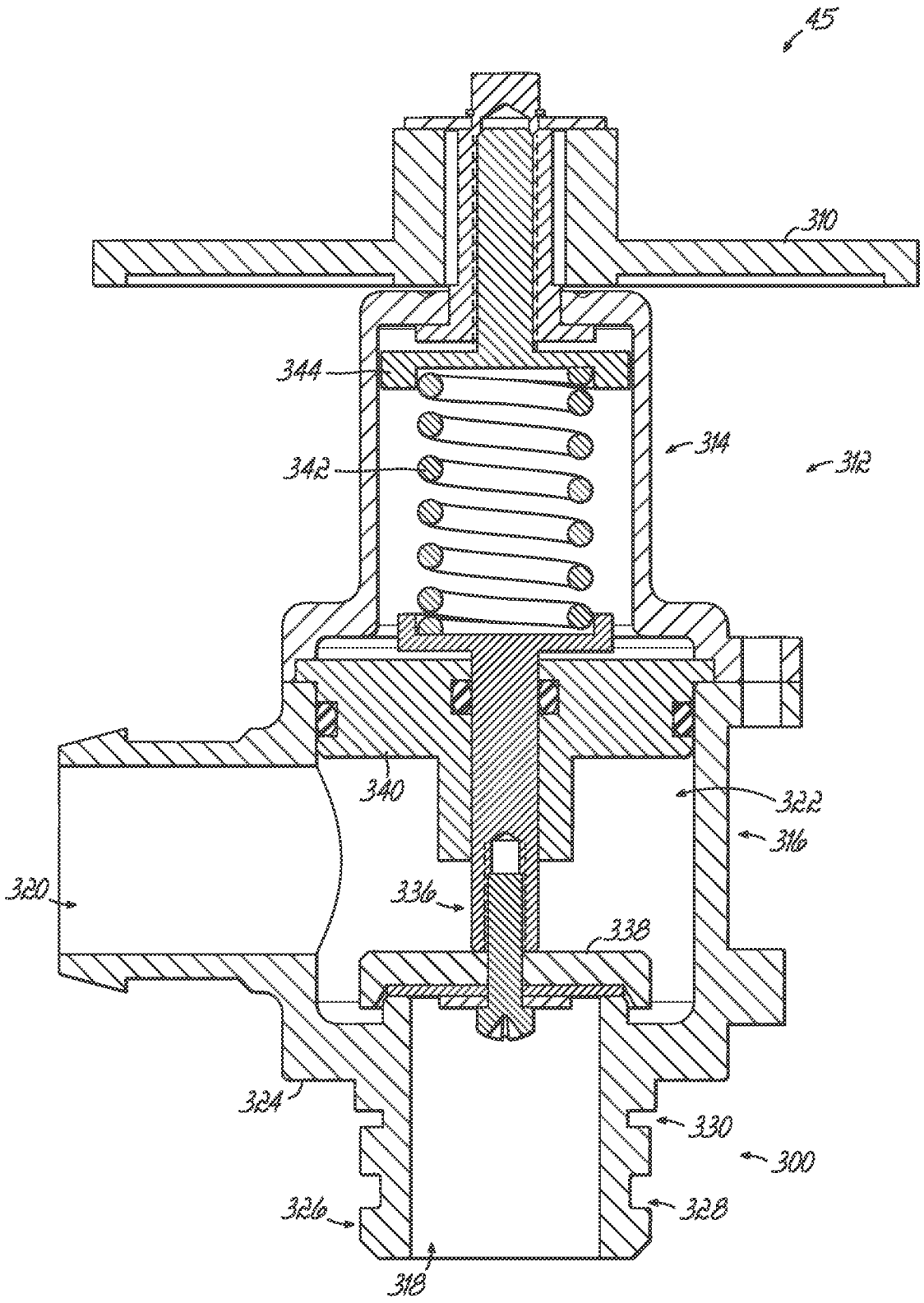
FIG. 18 is a cross-sectional view of a pressure relief device for use with a manifold block of the manifold system in accordance with an embodiment of the present invention.

Referring now to FIG. 18, the pressure relief valve 45 will now be described in further detail. As briefly described above, the pressure relief valve 45 is configured to be coupled to one of the first or the second female unions 212, 236 of a manifold block 122 and is used to control or limit pressure within the manifold system 12 and the fluid flow loop 26 of the chiller 10. As shown, the pressure relief valve 45 includes a handle 310, otherwise referred to as a thumb wheel, coupled to a valve body 312 having an upper housing 314 and a lower housing 316 having an inlet port 318 and an outlet port 320. The lower housing 316 defines a valve chamber 322. The male union 300 defines the inlet port 318 and extends a distance from a base 324 of the valve body 312 to define a tubular connector 326. The tubular connector 326 includes a first annular groove 328 configured to receive a sealing gasket therein, such as an o-ring, and a second annular groove 330 configured to receive portions of a spring clip 220 therein, such as the first and second bowed portions 266, 270, to couple the relief valve 45 to one of the first or the second female unions 212, 236 of a manifold block 122. The body 312 of the relief valve 45 further includes a mounting flange 332 (FIG. 17) having two bores 334 configured to be aligned with corresponding bores 222 in the first or second mounting flange 214, 238 of the manifold block 122 to receive appropriate fastening hardware therethrough to further couple the relief valve 45 to the manifold block 122. To this end, the mounting flange 332 provides the option to index the pressure relief valve 45, rotationally, in 90° increments, relative to the manifold block 122.

The relief valve 45 further includes a poppet 336 having a valve seat 338 located within the chamber 322 of the valve 45. The poppet 336 is slideably guided by an upper seal 340, otherwise referred to as a sealing cap, such that the valve seat 338 is movable between a closed and an open position for respectively closing and opening the inlet port 318. The upper seal 340 may be an X-ring seal or a four lobed o-ring, such as a QUAD-RING® brand seal (commercially available from Minnesota Rubber and Plastics, Minneapolis, MN), for example. The valve 45 further includes a spring 342 located within the upper housing 314 of the valve body 312. The spring 342 is positioned between the poppet 336 and a valve stem 344 for normally biasing the valve seat 338 to the closed position. The valve handle 310 coupled to the valve stem 344 and is used to adjust a force exerted on the poppet 336 by the spring 342 to thereby adjust the pressure setpoint at which the relief valve 45 opens to alleviate pressure buildup within the manifold system 12.

Referring now to FIGS. 19-22, details of an exemplary manifold block 422 for use with the manifold system 12 will now be described in accordance with an embodiment of the present invention. The manifold block 422 is compatible with the manifold block 122 such that the manifold blocks 122, 422 can be coupled together to form the fluid conduit 126. The fluid conduit 126 can also be formed by coupling a plurality of manifold blocks 422 together. The manifold block 422 is similar to the manifold block 122 and any portion of the manifold block 422 that is not discussed herein can be the same as the corresponding portion of the manifold block 422.

The manifold block 422 is generally T-shaped and includes a tubular body 500 that extends between a first end 502 and an opposite second end 504 to define a first fluid passageway 506 having a first flow axis 508. As best shown in FIG. 22, the first end 502 of the manifold block 422 includes a first opening 510 to the first fluid passageway 506 of the tubular body 500 that is defined by a first female union 512. Referring to FIG. 21, the first female union 512 includes a first mounting flange 514 and a neck 516 that extends from the first mounting flange 514 in a direction along the first flow axis 508 toward the second end 504 of the tubular body 500. The neck 516 includes a first channel 518 and a second channel 519 each of which is configured to receive a portion of a clip 520 (e.g., FIG. 21) therein to couple the manifold block 422 to another, like manifold block 422, as will be described in further detail below. The first and second channels 518, 519 can each include a first opening 525 and a second opening 527 (FIGS. 19 and 20) spaced from the first opening 525. The first and second openings 525, 527 can be separated by a portion of the neck 516 such that the clip 520 is restricted to enter or exit one of the first and second channels 518, 519 through one of the first and second openings 525, 527. The first mounting flange 514 includes a plurality of bores 522 configured to receive appropriate mounting hardware, such as screws or bolts, for example, for mounting the manifold block 422 directly to a support plate or a removable plate of the support plate.

The second end 504 of the manifold block 422 includes a second opening 524 to the first fluid passageway 506 of the tubular body 500 that is defined by a male union 526. The male union 526 includes an annular flange 528 and a tubular connector 530 that extends from the annular flange 528 in a direction along the first flow axis 508 to the second end 504 of the tubular body 500. The tubular connector 530 includes a first annular groove 532 configured to receive a sealing gasket therein, such as an o-ring (FIG. 22), and a second annular groove 534 configured to receive portions of a clip 520 therein to couple the manifold block 422 to another, like manifold block 422, or a component, as will be described in further detail below.

Figure 20:
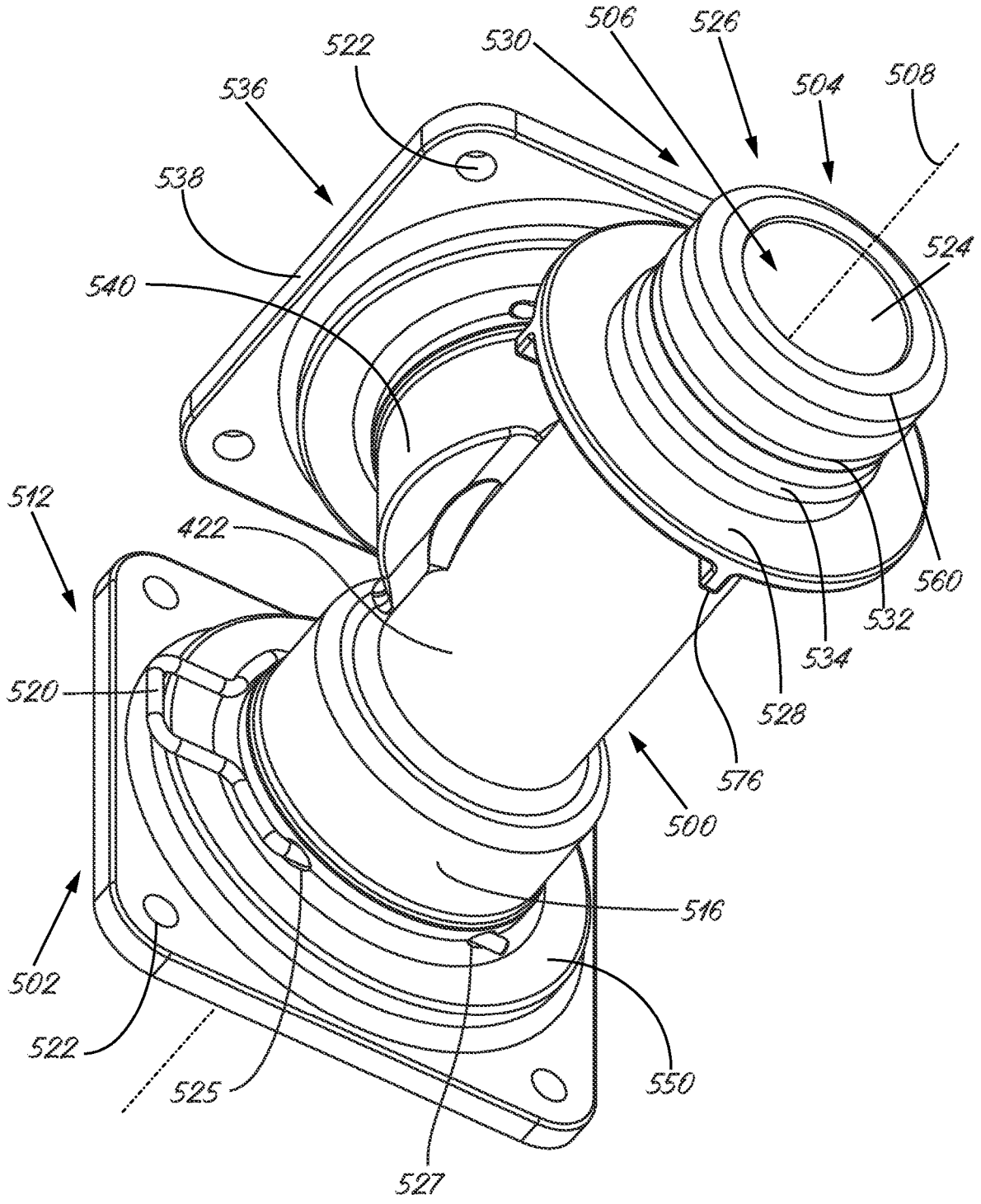
FIG. 20 is a perspective view of a manifold block of the manifold system of FIG. 19.
Figure 21:
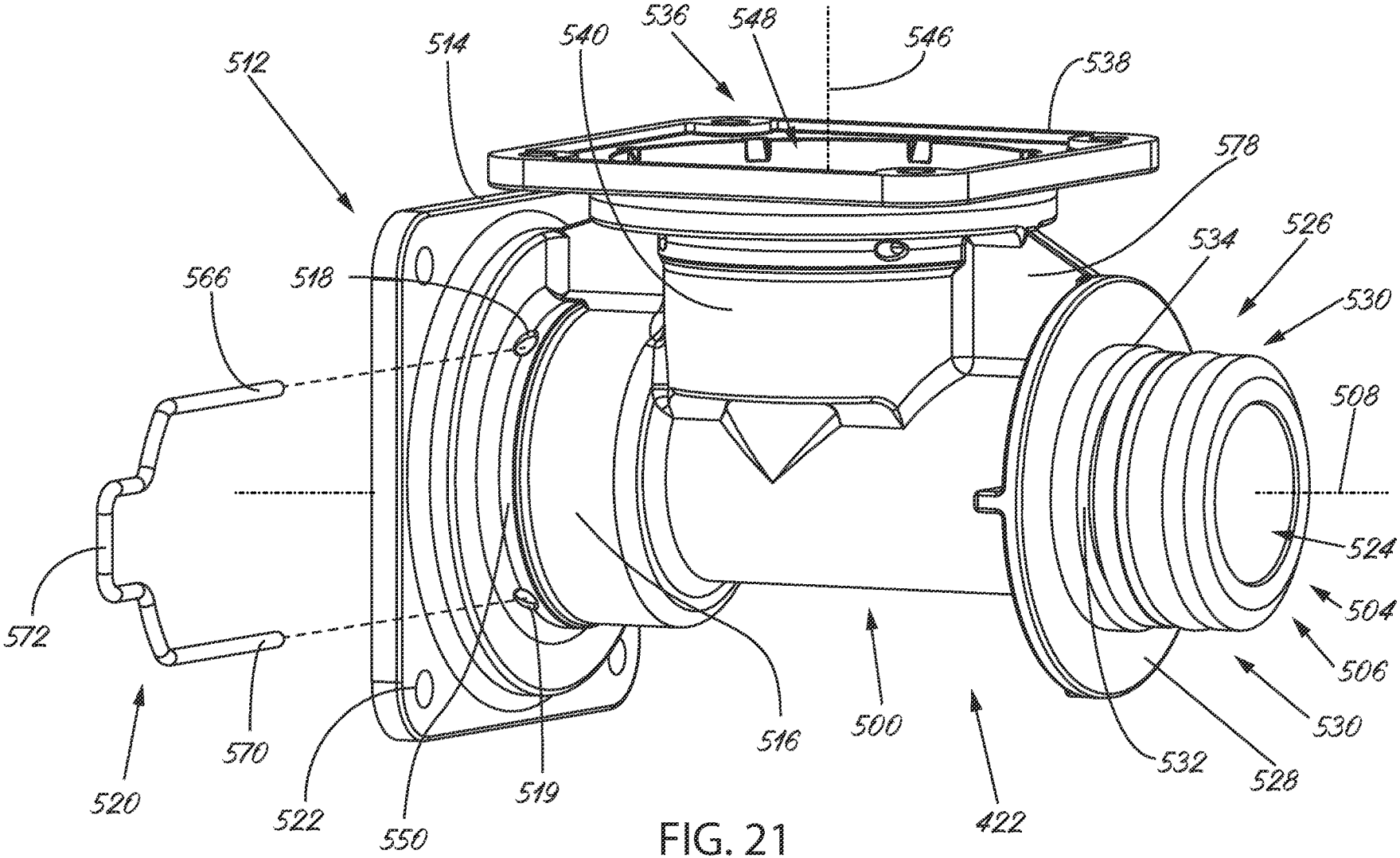
FIG. 21 is a perspective view of a manifold block of the manifold system of FIG. 19.
Figure 22:
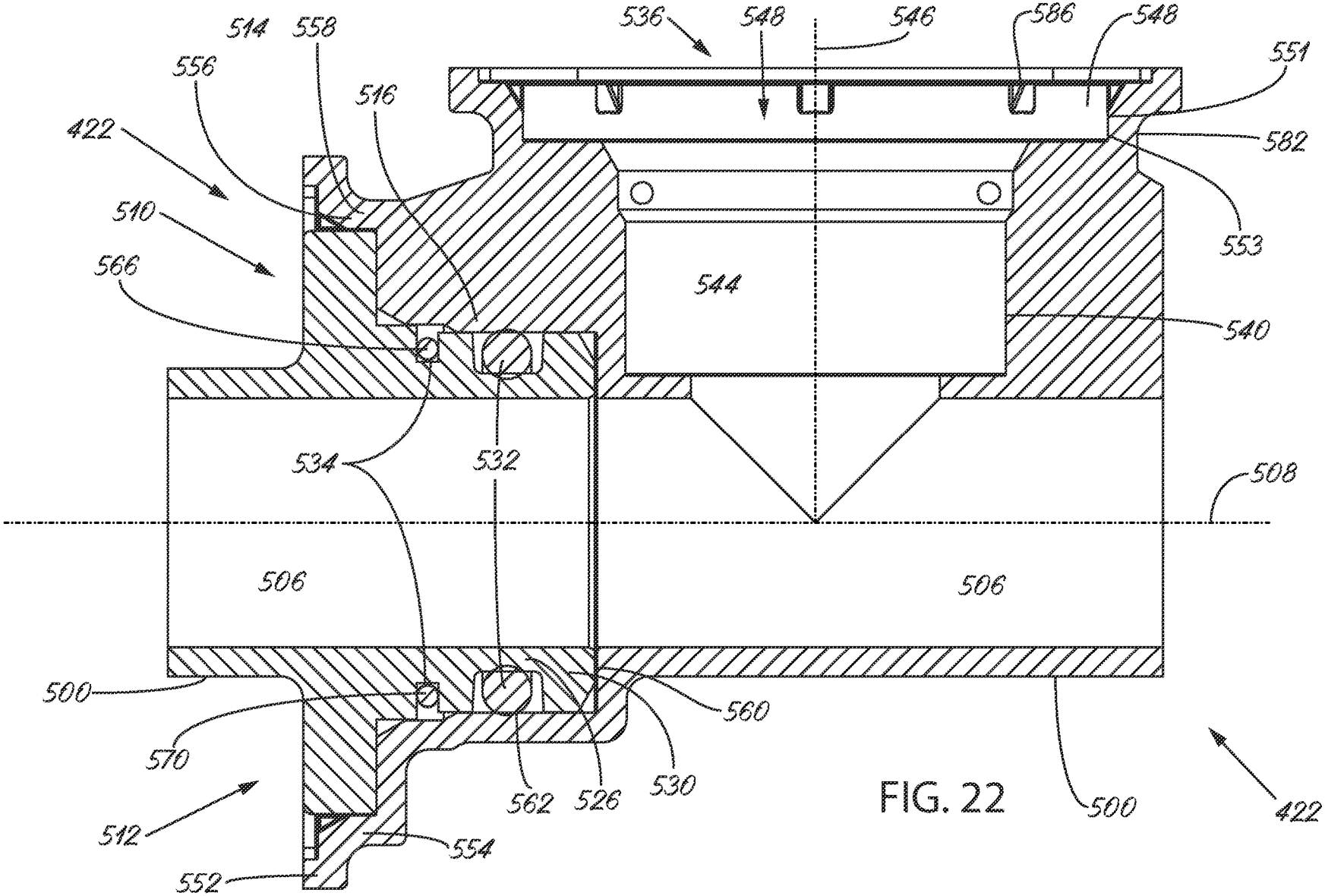
FIG. 22 is a cross-sectional view of a fluid engagement between two manifold blocks, illustrating a male union of a first manifold block coupled to a first female union of a second manifold block in a tool-less manner

With reference to FIGS. 20 and 21, the manifold block 422 includes a second female union 536 located generally at a midpoint along the tubular body 500 of the manifold block 422. The second female union 536 is defined by a second mounting flange 538 and a neck 540 that extends from the second mounting flange 538 in a direction toward the first fluid passageway 506 and to the tubular body 500. The neck 540 also includes a pair of channels 542 each of which is configured to receive a portion of a clip 520 therein to couple the manifold block 422 to another, like manifold block 422 or component. The second mounting flange 538 also includes a plurality of bores 522 configured to receive appropriate mounting hardware, such as screws or bolts, for example, for mounting the manifold block 422 to the support plate 420 or a removable plate 442 of the support plate 420, for example. As best shown in FIG. 22, the second female union 536 defines a second fluid passageway 544 in fluid communication with the first fluid passageway 506 of the tubular body 500. The second fluid passageway 544 defines a second flow axis 546 that is oriented transverse to the first flow axis 508. To this end, the second female union 536 defines an opening 548 to the second fluid passageway 544 of the manifold block 422 that is in fluid communication with the first fluid passageway 506 of the manifold block 422.

The configuration of the first and second female unions 512, 536 and the male union 526 of the manifold block 422 permit removable coupling of two or more manifold blocks 422 together to form part of the fluid conduit 126 of the manifold system 12. More particularly, as shown in FIG. 4, the first and second female unions 421, 536 of each manifold block 422 are each configured to selectively receive the male union 526 of a second manifold block 422, to fluidly couple the manifold blocks 422 together such that the first or second fluid passageways 506, 544 of the manifold block 422 and the first or second fluid passageways 506, 544 of the second manifold block 422 form part of the fluid conduit 126 of the manifold system 12. To this end, the first and second female unions 512, 536 are each shaped to receive the male union 526 therein, as described in further detail below.

Referring now to FIG. 10, the first opening 510 to the first fluid passageway 506 that is defined by the first female union 512 of the manifold block 422 has a generally stepped profile that reduces in size in a direction from the mounting flange 514, where a diameter of the opening 510 is the largest, to the tubular body 500, where a diameter of the opening 510 is the smallest. In this regard, the neck 516 of the first female union 512 defines the smaller diameter of the opening and an enlarged portion 550 of the neck 516 adjacent to the flange 514 defines the larger diameter of the opening 510. As best shown in FIG. 22, the enlarged portion 550 of the neck 516 defines a first annular wall 552 and a first annular shoulder 554 and the neck 516 defines a second annular wall 556 and a second annular shoulder 558. The stepped profile of the first female union 512 corresponds to a generally stepped profile of the male union 526 defined by the transition between the annular flange 528 and the tubular connector 530. In this regard, the male union 526 of a first manifold block 422 is configured to be received within the first female union 512 of a second manifold block 422. When so positioned the tubular connector 530 is received within the neck 516 of the first female union 512 and the annular flange 528 is received within the enlarged portion 550 of the neck 516. More particularly, an annular tip 560 of the tubular connector 530 is in an abutting or near abutting relationship with the second shoulder 558 of the neck 516, and the annular flange 528 of the male union 526 is engaged with the first annular shoulder 554 of the enlarged portion 550 of the neck 516. To this end, a gasket such as an o-ring 562, for example, forms a seal between the tubular connector 530 and the second annular wall 556 of the neck 516. As shown in FIG. 22, the engagement between the two manifold blocks 422 places the first fluid passageway 506 of the first manifold block 422 in direct fluid communication with the first fluid passageway 506 of the second manifold block 422 such that the first flow axes 508 are coaxial.

As briefly described above, the first and second manifold blocks 122 are configured to be removably coupled together with a clip 520. As shown in FIG. 21, each clip 520 is generally U-shaped with a first leg 566 and a second leg 570. The first and second legs 566, 570 can be generally straight. The first and second legs 566, 570 can be parallel to each other. The first and second legs 566, 570 can be flexible. The clip 520 also includes a tab portion 572 configured to be gripped by a user to insert or remove the clip 520 from the manifold block 422, for example. Referring to FIG. 22, when the male union 526 of one manifold block 422 is received within the first female union 512 of a second manifold block 422, the second annular groove 534 of the tubular connector 530 is aligned with the first and second channels 518, 519 in the neck 516 of the first female union 512. When so positioned, the first and second legs of the clip 520 are moved through the first and second channels 518, 519 respectively, and pressed into engagement with the aligned annular groove 534 to couple the first and second manifold blocks 422 together, as shown. More particularly, the first leg 566 of the clip 520 is received within the first channel 518 and the annular groove 534 and the second leg 570 of the clip 520 is received within the second channel 519 and the annular groove 534. To this end, the first and second legs 566, 570 are in a confronting relationship with side walls of the annular groove 534 to thereby prevent the male union 526 from becoming disengaged with the first female union 512. The inner wall of the neck 516 can prevent the first and second legs 566, 570 from splaying when the first and second legs 566, 570 are positioned in the annular groove 534. The first leg 566 can be positioned between a portion of the neck 516 and an end wall of the annular groove 534 in a radial direction.

With continued reference to FIGS. 8-12, the male union 526 includes a plurality of splines 576 formed on the annular flange 528 of the male union 526 and being spaced apart circumferentially about the annular flange 528. Each spline 576 generally extends from the tubular body 500 of the manifold block 422 to a periphery of the annular flange 528. As best shown in FIG. 21, the male union 526 includes a gusset 578 that extends between the annular flange 528 of the male union 526 and the neck 540 of the second female union 536. The gusset 578 functions as an indexing feature configured to be received within a corresponding first indexing feature of the first female union 512 to properly orient a first manifold block 422 relative to a second manifold block 422 for attachment thereto.

Figure 19:
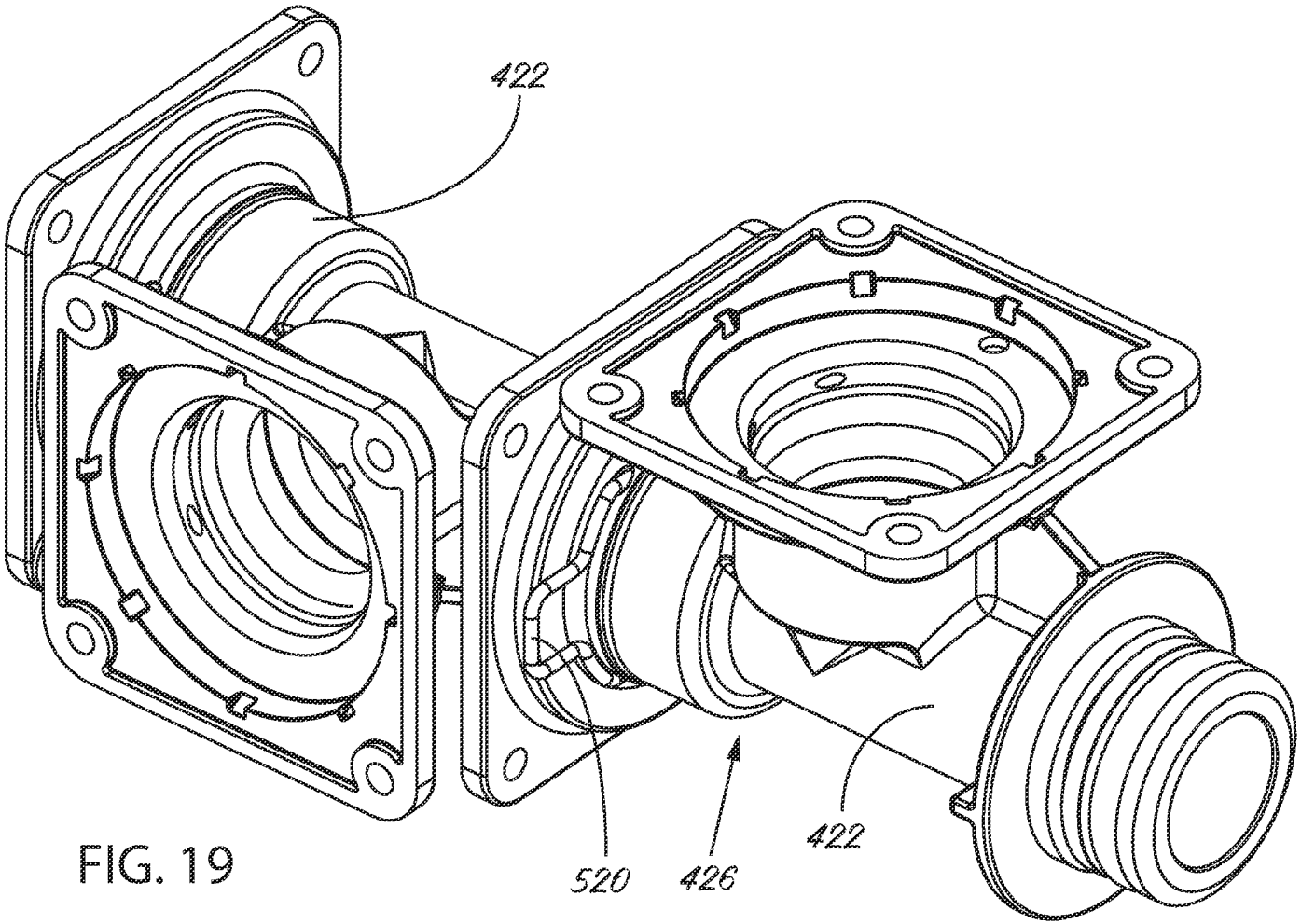
FIG. 19 is a perspective view of a configurable manifold system for use with the refrigerated process chiller of FIG. 1, illustrating a plurality of manifold blocks removably coupled together to form part of the manifold system in accordance with an embodiment of the present invention.
Figure 23:
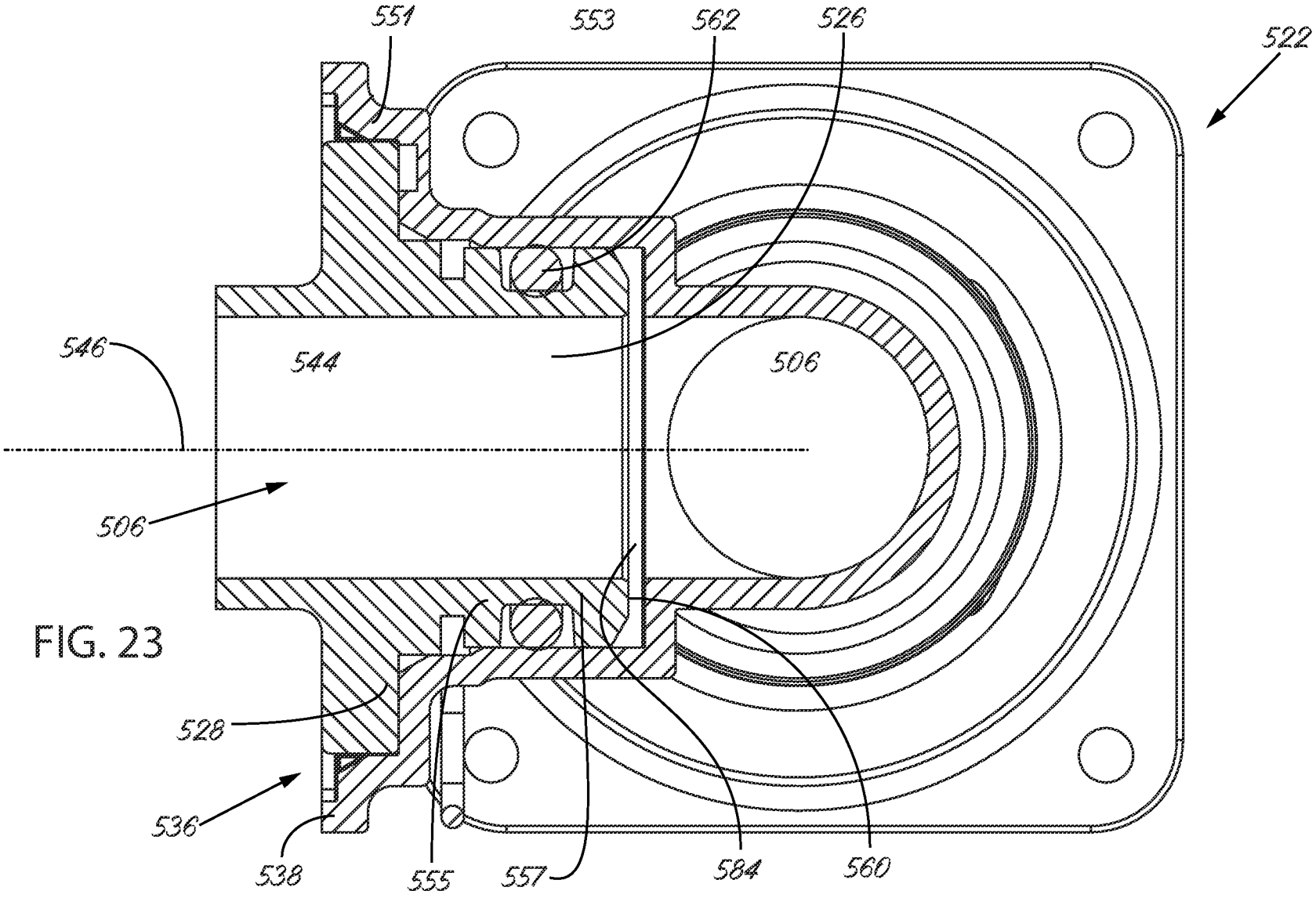
FIG. 23 is a cross-sectional view of a fluid engagement between two manifold blocks, illustrating a male union of a first manifold block coupled to a first female union of a second manifold block in a tool-less manner.

With reference to FIGS. 21 and 23, the second female union 536 is also configured to receive the male union 526 of a like, second manifold block 422, to fluidly couple the manifold blocks 422 together, as shown in FIG. 19. In this regard, the configuration of the second female union 536 is similar in many respects to the configuration of the first female union 512 described above. More particularly, the opening 548 to the second fluid passageway 544 that is defined by the second female union 536 of the manifold block 422 has a generally stepped profile that reduces in size in a direction from the second mounting flange 538, where a diameter of the opening 548 is the largest, to the tubular body 500, where a diameter of the opening 548 is the smallest. More particularly, the neck 540 of the second female union 536 defines the smaller diameter of the opening 548 and an enlarged portion 582 of the neck 540 adjacent to the flange 538 defines the larger diameter of the opening 548. As best shown in FIG. 23, the enlarged portion 582 of the neck 540 defines a first annular wall 551 and a first annular shoulder 553 and the neck 540 defines a second annular wall 255 and a second annular shoulder 257. The stepped profile of the second female union 536 generally corresponds to the profile of the tubular connector 530 and the annular flange 528 of the male union 526. However, a size of the neck 540 of the second female union 536 (e.g., a height of the second annular wall 555 measured between the second annular shoulder 557 and the enlarged portion 582 of the neck 540) may be different compared to a size of the neck 516 of the first female union 512. In this regard, the neck 540 of the second female union 536 is larger compared to the neck 516 of the first female union 512 to accommodate larger components, or a component located between the male union 526 and the second female union 536, such as the check valve 48, for example.

FIG. 23 illustrates the male union 526 of a first manifold block 422 engaged with the second female union 536 of a second manifold block 422 to couple the two manifold blocks 422 together. As shown, the tubular connector 530 is received within the neck 540 of the second female union 536 and the annular flange 528 is received within the enlarged portion 582 of the neck 540. The annular tip 560 of the tubular connector 530 is in a near abutting relationship with the second annular shoulder 557 such that a gap 584 is formed between the annular tip 560 of the tubular connector 530 and the second annular shoulder 557. As shown, the annular flange 528 of the male union 526 is engaged with the first annular shoulder 553 of the enlarged portion 582 of the neck 540. To this end, the o-ring 562 forms a seal between the tubular connector 530 and the second annular wall 555 of the neck 540. The engagement between the two manifold blocks 422 places the first fluid passageway 506 of the first manifold block 422 in direct fluid communication with the second fluid passageway 544 of the second manifold block 422 such that the first flow axis 508 of the first manifold block 422 and the second flow axis 546 of the second manifold block 422 are coaxial. The male union 526 of the first manifold block 422 is also coupled to the second female union 536 of the second manifold block 422 with a clip 520. In this regard, the clip 520 is pressed into engagement with the aligned second annular groove 534 of the tubular connector 530 and the channels 542 formed in the neck 540 of the second female union 536 to couple the manifold blocks 422 together, as shown. More particularly, the first leg 566 of the clip 520 may be received within the first channel 518 and the second annular groove 534 and the second leg 570 of the clip 520 may be received within the second channel 519 and the annular groove 534 to prevent the male union 526 from becoming disengaged with the second female union 536.

Referring again to FIG. 22, the second female union 536 includes a plurality of first indexing features in the form notches 586. The first female union 512 can also include notches arranged in a similar pattern to notches 586. The notches 586 are each configured to receive the gusset 578 of the male union 526 for indexing and alignment of another manifold block 422, for example. In that regard, the notches 586 are generally formed in the first annular wall 551 of the enlarged neck portion 582 and extend angularly between the first annular wall 551 and the second mounting flange 538. As shown, the second female union 536 also includes eight notches 586 spaced apart about a circumference of the first annular wall 551 in 45° increments. However, the second female union 536 may include more or less notches 586 that are spaced apart in greater or smaller increments about the circumference of the first annular wall 551, such as sixteen notches 586 spaced apart in 22.5° increments, or four notches 586 spaced apart in 90° increments, for example.

In a preferred embodiment, the manifold block 422 described above may be formed through a molding process, such as an injection molding process, using a suitable engineering material. For example, the manifold block 422 may be formed from Polyphenylene Sulfide (PPS) compound such as Ryton® R-4 or other suitable engineered thermoplastic. However, it will be recognized that other processes and materials are also possible.

According to one embodiment of the present invention, the manifold block 422 may be manufactured using a three-dimensional (3D) printing manufacturing method. The term "three-dimensional printing" or "additive manufacturing" or "rapid prototyping" refers to a process of making a three-dimensional solid object of virtually any shape from a digital model. 3D printing of the manifold block 422 is achieved using an additive process, where successive layers of material are laid down in different shapes to build the structures that define the manifold block 422. The term 3D printing, as used herein, may refer to methods such as, but not limited to, selective laser melting (SLM), direct metal laser sintering (DMLS), selective laser sintering (SLS), fused deposition modeling (FDM), and stereolithography (SLA). Further, any type of 3D printing machine that can print the materials described herein may be used. In this regard, computer-readable program instructions stored in a computer-readable medium may be used to direct a computer of a 3D printing machine, other types of programmable data processing apparatuses, or other devices to function in a particular manner, such that the instructions stored in the computer-readable medium produce an article of manufacture including instructions that implement the functions, acts, or operations specified in the flowcharts, sequence diagrams, or block diagrams used to 3D print the manifold block 422. The computer program instructions may be provided to one or more processors of a general purpose computer, a special purpose computer, or other programmable data processing apparatus to produce a machine, such that the instructions, which execute via the one or more processors, cause a series of computations to be performed to implement the functions, acts, or operations specified in the text of the specification, flowcharts, sequence diagrams, or block diagrams. Once the 3D printing machine has been provided with a model or computer-readable program instructions suitable for use in manufacturing the manifold block 422, the 3D printing machine may be operated to lay down successive layers of the desired material to build the manifold block 422 on a suitable substrate.

While the present invention has been illustrated by a description several exemplary embodiments and while these embodiments have been described in detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the general inventive concept.

What is claimed is:

1. A manifold system comprising:

a plurality of manifold blocks, wherein each block of the plurality of manifold blocks comprises:

a tubular body extending between a first end and an opposite second end to define a first fluid passageway having a first flow axis, the first end having a first female union defined by a first mounting flange and a neck that extends from the first mounting flange in a direction along the first flow axis toward the second end of the tubular body, the first female union defining an opening to the first fluid passageway of the tubular body at the first end, and the second end having a male union defined by an annular flange and a tubular connector that extends from the annular flange in a direction along the first flow axis to the second end of the tubular body, the male union defining an opening to the first fluid passageway of the tubular body at the second end, the male union further comprising a gusset;

a second female union defined by a second mounting flange and a neck that extends from the second mounting flange in a direction toward the first fluid passageway to define a second fluid passageway in fluid communication with the first fluid passageway and having a second flow axis oriented transverse to the first flow axis, the second female union defining an opening to the second fluid passageway of the tubular body in fluid communication with the first fluid passageway; and the first female union and the second female union each comprising an annular wall having a plurality of indexing features formed therein, at least one of the plurality of indexing features configured to receive the gusset of the male union to enable each block of the plurality of manifold blocks to be rotationally incrementally indexed relative to each other.

2. The manifold system of claim 1, wherein the first and the second female unions of each manifold block are each configured to selectively receive a male union of a second manifold block to removably couple the manifold block and the second manifold block together such that the first or second fluid passageway of the first manifold block and the first or second fluid passageway of the second manifold block form part of the fluid conduit of the manifold system.

3. The manifold system of claim 2, wherein the neck of the first female union and the neck of the second female union each comprise a pair of slots and the tubular connector of the male union comprises an annular groove configured to align with the pair of slots of a first or a second female union of the second manifold block when received therein, wherein the manifold block is removably coupled to the second manifold block with a clip that is positioned within the pair of slots of the first or the second female union of the second manifold block and the annular groove of the male union of the manifold when aligned.

4. The manifold system of claim 3, wherein the clip is a spring clip that includes a first bowed portion and a second bowed portion configured to be received within the pair of slots and the annular groove.

5. The manifold system of claim 1, wherein the neck of the first female union and the neck of the second female union each include an enlarged portion that defines the annular wall and an annular shoulder that is configured to receive an annular flange of a male union of a second manifold block.

6. The manifold system of claim 5, wherein the plurality of indexing features are spaced apart about a perimeter of the annular wall.

7. The manifold system of claim 6, wherein the plurality of indexing features comprise notches in each annular wall.

8. The manifold system of claim 7, wherein the plurality of indexing features are each spaced apart in 45 degree increments about the circumference of the annular wall.

9. The manifold system of claim 5, wherein at least the annular shoulder of the second female union includes at least one second indexing feature configured to engage an alignment feature of a component attached to the second female union to orient the component to be in an indexed position.

* * * * *